US005134444A

United States Patent [19]

Tabuchi et al.

[11] Patent Number: 5,134,444

[45] Date of Patent: Jul. 28, 1992

[54] IMAGE FORMING APPARATUS

[75] Inventors: Kenji Tabuchi; Tateki Oka, both of Toyohashi; Hideyuki Kanbayashi, Toyokawa, all of Japan

[73] Assignee: Minolta Camera Kabushiki Kaisha, Osaka, Japan

[21] Appl. No.: 699,750

[22] Filed: May 14, 1991

[30] Foreign Application Priority Data

May 15, 1990 [JP] Japan ..... 2-126320
May 15, 1990 [JP] Japan ..... 2-126321
Jan. 14, 1991 [JP] Japan ..... 3-2570

[51] Int. Cl.[5] ..... G03G 15/01

[52] U.S. Cl. ..... 355/326; 355/208; 355/328; 355/32

[58] Field of Search ..... 355/326-328, 355/32, 208, 246; 430/42

[56] References Cited

U.S. PATENT DOCUMENTS

| | | | |
|---|---|---|---|
| 4,189,224 | 2/1990 | Sakai | 355/326 |
| 4,264,185 | 4/1981 | Ohta | 355/326 |
| 4,351,664 | 9/1982 | Karasawa | 355/326 |
| 4,671,646 | 6/1987 | Florack et al. | 355/326 |
| 4,822,702 | 4/1989 | Hoshi | 430/42 |

FOREIGN PATENT DOCUMENTS

| | | | |
|---|---|---|---|
| 0108551 | 6/1963 | Japan | 355/326 |
| 00143363 | 7/1985 | Japan | 355/326 |
| 0179758 | 9/1985 | Japan | 355/326 |
| 0061269 | 3/1988 | Japan | 355/326 |
| 58-102251 | 6/1988 | Japan . | |
| 0265257 | 11/1988 | Japan | 355/326 |
| 58-224363 | 12/1988 | Japan . | |
| 0076078 | 3/1989 | Japan | 355/326 |

*Primary Examiner*—A. T. Grimley
*Assistant Examiner*—Matthew S. Smith
*Attorney, Agent, or Firm*—Willian Brinks Olds Hofer Gilson & Lione

[57] ABSTRACT

An image forming apparatus which develops two latent images formed on a photoreceptor with developing agents respectively containing first and second toners of different colors, and is so constructed that, a clear image is obtained by processing mixed-color separation to restrain the mixed-color as much as possible, in response to respective consumptions of a first toner and a second toner, or every time a fixed amount of first toner is consumed, and further, in response to the amount of first toner mixed into a second developing agent detected when a fixed amount of first toner is consumed.

19 Claims, 22 Drawing Sheets

Vo
Ov
1st CHARGING

Vo
Ov
1st EXPOSING

Vo
Vb
Ov
Tc
1st DEVELOPING

Vo
Tc
Ov
2nd CHARGING

Vo
Tc
Ov
2nd EXPOSING

Vo
Vb
Ov
Tc
Tc
Tb
2nd DEVELOPING

Fig 17

| | PRINT MODE | | |
|---|---|---|---|
| | BLACK | RED | TWO-COLOR |
| FLAG A | 0 | 1 | 0 |
| FLAG B | 0 | 0 | 1 |

IMAGE FORMING APPARATUS

BACKGROUND OF THE INVENTION

1. Field of the Invention

The present invention relates to an image forming apparatus. Particularly, it relates to a two-color image forming apparatus for forming a simultaneous two-color image with plural colors, more specifically, to improvement of a mixed-color separation technique at development in a two-color printer and a two-color copying machine, having a two-color image forming process based on an electro-photographic process.

2. Description of the Related Art

In a simultaneous two-color copying machine, for example, by a black toner and a red toner (color toner) as a two-color image forming apparatus, a block image and a red image are read by a light receiving element, and by laser beam having two kinds of wave-length modulated respectively responsive thereto, two different locations in a circumferential direction on a photosensitive drum are exposed to form latent images of each of the respective color images.

At this time, in order to improve visual recognition of the image, the exposed positions of respective colors are such that, usually a red image is charged and exposed on the more upstream side in the rotating direction of the photosensitive drum than a black image, and is developed by a first developing unit containing the red toner. The black image is recharged and exposed after development of the red image, and developed by a second developing unit containing the black toner.

Accordingly, there is a possibility that the red toner is contacted to a developing agent in the second developing unit and scraped off and mixed therein, when the red image having developed by the first developing unit passes through the position of the second developing unit, thereby when the black image is developed, there is a possibility that the image which is originally black may change into a mixed-color image of black and red.

Such problem is encountered conspicuously in the case where the second developing unit is a so-called magnetic brush-type developing unit. This is because, in the magnetic brush-type developing unit, the development takes place by contacting a magnetic brush of the developing agent composed of toner and carrier to the photosensitive drum, so that the red toner which has been developed previously by the first developing unit is scraped off by the magnetic brush formed of the second developing unit.

In order to prevent a so-called color mixture as stated above, conventionally, a technique disclosed, for example, in the U.S. Pat. No. 4,822,702 is known as a mixed-color separation technique.

In the aforesaid U.S. Pat. No. 4,822,702, a two-component developing agent composed of the red toner and carrier is contained in the first developing unit located on the up-stream side of the photosensitive drum, and a two-component developing agent composed of the black toner and carrier is contained in the second developing unit located on the downstream side thereof. Both the red and black toners used here are the non-magnetic toner. The red toner has such a characteristic that it is charged in opposite polarity by a friction charge when mixed with a second developing agent containing the black toner. That is, there is a difference in physical properties between the red toner and the black toner.

Since the red toner having the aforesaid characteristic is stuck to a non-image portion (charged portion) of the photosensitive drum at development by the second developing unit when mixed with the second developing agent, it is removed from the second developing unit. Since a charge polarity of the red toner stuck to the non-image portion on the photosensitive drum is the same polarity as an applied voltage of a transfer charger, the red toner remains on the photosensitive drum and is scraped off and recovered by a cleaner without being transferred onto a copying paper. In the U.S. Pat. No. 4,822,702 stated above, mixed-color separation is effected automatically during development in such a manner.

As disclosed in Japanese Patent Application Laid-Open No. 58-102251, a technique for separating the first toner by giving a difference between development thresholds of the first toner and the second toner, or in other words, giving a difference between development starting potentials by the toners, and using a recovery roll applied with a bias voltage is known.

In the prior art aforementioned, however, though it is theoretically possible to separate only the first toner from the second developing agent, in practice, a considerable amount of second toner is also contained in the first toner being recovered, thus it is impossible to separate completely. In the case where the first toner is mixed only a little into the second developing agent, most of the toner being recovered is the second toner, result in waste of the second toner.

It is believed that such a problem can be solved to some extent by setting the conditions of separating the first toner severely. In that case, however, there is a high possibility that such conditions are not met, because kinds and ranges of the toner which can be used are limited, and charging characteristics of the toner changes due to variations in the surrounding environment, so that it is not an effective way.

Furthermore, even when a difference of physical properties exists between the toners of different colors as stated above, when the amount of red toner mixed into the second developing agent exceeds the separated amount, a mixed-color separation may not be effected sufficiently only by the mixed-color separation wherein the red toner is stuck to the non-image portion as aforementioned, and a rate of mixed-color may increase.

Particularly, when the image forming frequency increases in the state that image density of the red image, or a ratio of image portion relative to a whole image area is high, and image density of the black image is low, the red toner tends to mix largely into the second developing agent and the mixed toner can not be removed sufficiently, increasing the rate of mixed-color.

Meanwhile, in the case of the color toner which is charged in opposite polarity when mixed with the black toner, separation capacity also depends on the mixing ratio of the carrier and the black toner of the second developing agent and a stirring time and magnitude of the second developing agent, besides the aforesaid difference in physical properties between the color toner and the black toner, or the difference in electrification ranks. Here, the larger the mixed ratio is, the higher the separation capability becomes, and conversely, the separation capability disappears when the mixed ratio becomes 3% or less. Moreover, the separation capability reduces as the stirring time becomes longer, and the more the replenishing amount of the new black toner, the higher the separation capability.

In the case aforementioned, the amount of color toner mixed into the second developing agent depends on the conditions of the second development such as a developing process, physical properties of the carrier and setting condition, and the consumed amount of color toner. While, even when the color toner is mixed, in the case where the development by the black toner is effected, the color toner is stuck to the non-image portion and removed, so that when a large amount of black toner is used, the mixed amount is reduced gradually.

Furthermore, the first toner is mixed into the second developing agent only when the first developing unit is operated, and when only the second developing unit is operated during a standstill of the first developing unit, there is hardly any possibility that the first toner is mixed into the second developing agent. In other words, responsive to the used amount of first toner, the first toner mixed into the second developing agent increases. Accordingly, by detecting the consumed amount of the first toner and separating and recovering it in response to the detected result of detection, the consumption of the second toner can be prevented.

SUMMARY OF THE INVENTION

The present invention having been devised in view of such learnings, therefore, it is a first object thereof to provide an image forming apparatus in which a clear image with little mixed-color is always obtained, by detecting respective consumptions of a first developing agent (color toner) and a second developing agent (black toner), and controlling mixed-color separation in response to the relationship therebetween.

It is a second object of the present invention to provide an image forming apparatus in which a clear image with little mixed-color is always obtained, by detecting consumption of a first toner and controlling mixed-color separation every time a fixed amount of first toner is consumed.

Furthermore, it is a third object of the present invention to provide an image forming apparatus in which a clear image with little mixed-color is always obtained, by detecting consumption of the first developing agent, and detecting the mixed amount of first developing agent into the second developing agent every time a fixed amount of the first toner is consumed and by controlling mixed-color separation responsive to the result.

The image forming apparatus according to the present invention comprises: first and second developing means respectively containing the first and second developing agents whose colors and characteristics are different from each other for developing a latent image; consumption detecting means for detecting values related to consumptions of both of the developing agents; separation means for separating the first developing agent from a second developing unit; and control means for controlling the separation means in response to respective detected values related to the respective consumptions.

By such a configuration, for example, a count number of dots of the image formed by using the first and second developing means, or the values related to consumptions of the first and second developing agents such as replenishing amounts thereof are detected respectively, whether or not to start the mixed-color separation is determined according to the detected consumption of the first developing agent, and the operation time of mixed-color separation is so controlled to be fixed responsive to the difference therebetween according to the relationship between the consumptions of the first and second developing agents, for example, in the case where the consumption of the first developing agent is larger than that of the second developing agent.

The image forming apparatus of the present invention also comprises: consumption detecting means for detecting consumption of the first developing agent; separation means for separating the first developing agent from the second developing unit; and control means for operating the separation means every time a fixed amount of first developing agent is consumed.

By such a configuration, the separation means is operated in response to the consumption of the first developing agent, so that the separation is effected at adequate frequency.

Meanwhile, the image forming apparatus of the present invention comprises: consumption detecting means for detecting consumption of the first developing agent; mixed amount detecting means for detecting the mixed amount of the first developing agent into the second developing agent; separation means for separating the first developing agent from the second developing unit; and control means for operating the mixed amount detecting means and operating the separation means responsive to the result, every time a fixed amount of first developing agent is consumed.

By such a configuration, the mixed amount detecting means is operated in response to the consumption of the first developing agent, and the separation means is operated responsive to the result, so that the separation is effected at adequate frequency.

The above and further objects and features of the invention will more fully be apparent from the following detailed description with accompanying drawings.

BRIEF DESCRIPTION OF THE DRAWINGS

FIG. 17 is a table showing the relationship between a printing mode and the states of flags A and B.

DESCRIPTION OF THE PREFERRED EMBODIMENT

In the following, the present invention will be described in details with reference to the drawings showing its embodiment.

Figure 1:
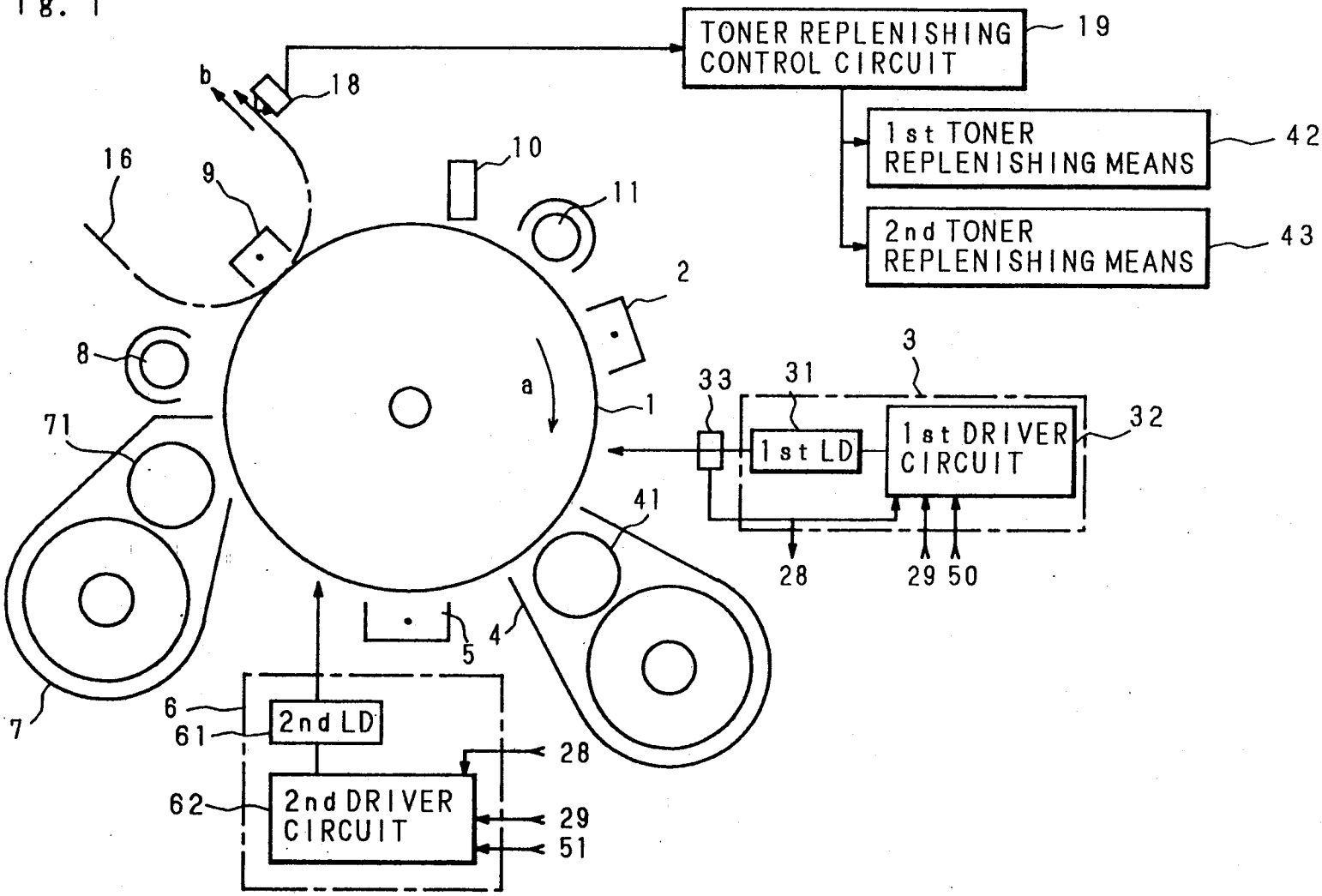
FIG. 1 is a sectional view showing a schematic configuration of essential portions of a first embodiment of a two-color laser beam printer which is an image forming apparatus according to the present invention.
Figure 2:
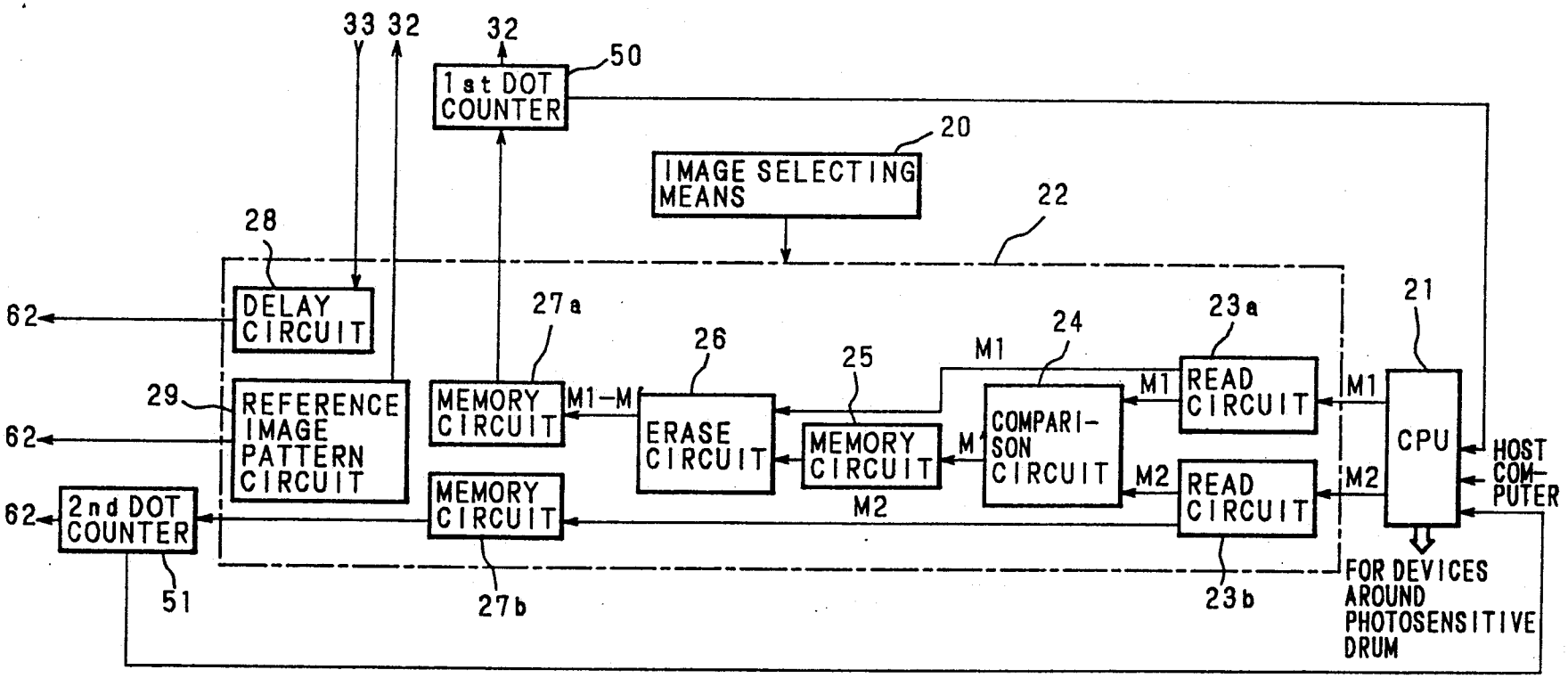
FIG. 2 is a block diagram showing a configuration of its control system.

FIG. 1 is a sectional view showing a schematic configuration of essential portions of a first embodiment of a two-color laser beam printer, which is an image forming apparatus according to the present invention, and FIG. 2 is a block diagram showing a configuration of its control system.

In FIG. 1, numeral 1 designates a photosensitive drum, on the surface of which a light conductive film such as a-Si or the like is formed. The photosensitive drum 1 is disposed rotatably in a direction of an arrow a, and around the photosensitive drum 1 along the rotating direction thereof, in sequence from the upstream side, a first charger 2, a first optical system 3, a first developing unit 4, a second charger 5, a second optical system 6, a second developing unit 7, an eraser lamp 8, a transfer charger 9, a blade-type cleaner 10 and a main eraser 11 are disposed.

Numeral 16 designates a copying paper to be described later.

The first and second chargers 2, 5 apply a constant potential (positive polarity in this embodiment) uniformly on the surface of the photosensitive drum 1 according to corona discharge thereof.

A first and a second optical systems 3 and 6 form predetermined images on the surface of the photosensitive drum 1 as negative electrostatic latent images, by laser beams from first and second diodes (hereinafter referred to as LD) 31, 61 driven by first and second driver circuits 32, 62.

Each of the driver circuits 32, 62 is controlled by an image control unit 22 shown in FIG. 2 to be described later.

For example, a ruled line is formed as an image by the first optical system 3, and by the second optical system 6, a character printed inside the ruled line is formed as an image.

The first and second developing units 4, 7 are both the magnetic brush type including a developing sleeve 41 in which a magnetic roller is built in. In the first developing unit 4, a first developing agent composed of a mixture of insulative non-magnetic color toner (e.g. red toner) and magnetic carrier having a fine grain size is contained, and in the second developing unit 7, a second developing agent composed of a mixture of insulative non-magnetic black toner and magnetic carrier having a fine grain size is contained.

In the frictional electrification rank, the color toner is on a more negative side than the black toner and when mixed into the second developing unit 7, it contacts with the black toner and friction-charged negatively. This charging characteristic is an opposite polarity to the charging characteristic (positive polarity) of the photosensitive drum 1. In this embodiment, toners are friction-charged in positive polarity and the carriers are friction-charged in negative polarity.

As the first and second developing units 4, 7, a plurality of same type developing units are prepared, and respectively provided with the developing agents including various toners of different colors. The developing units are exchangeable so that two-color image can be formed by combining optional colors.

Next, the configuration and schematic operation of the developing unit will be explained taking the second developing unit 7 as an example.

Figure 3:
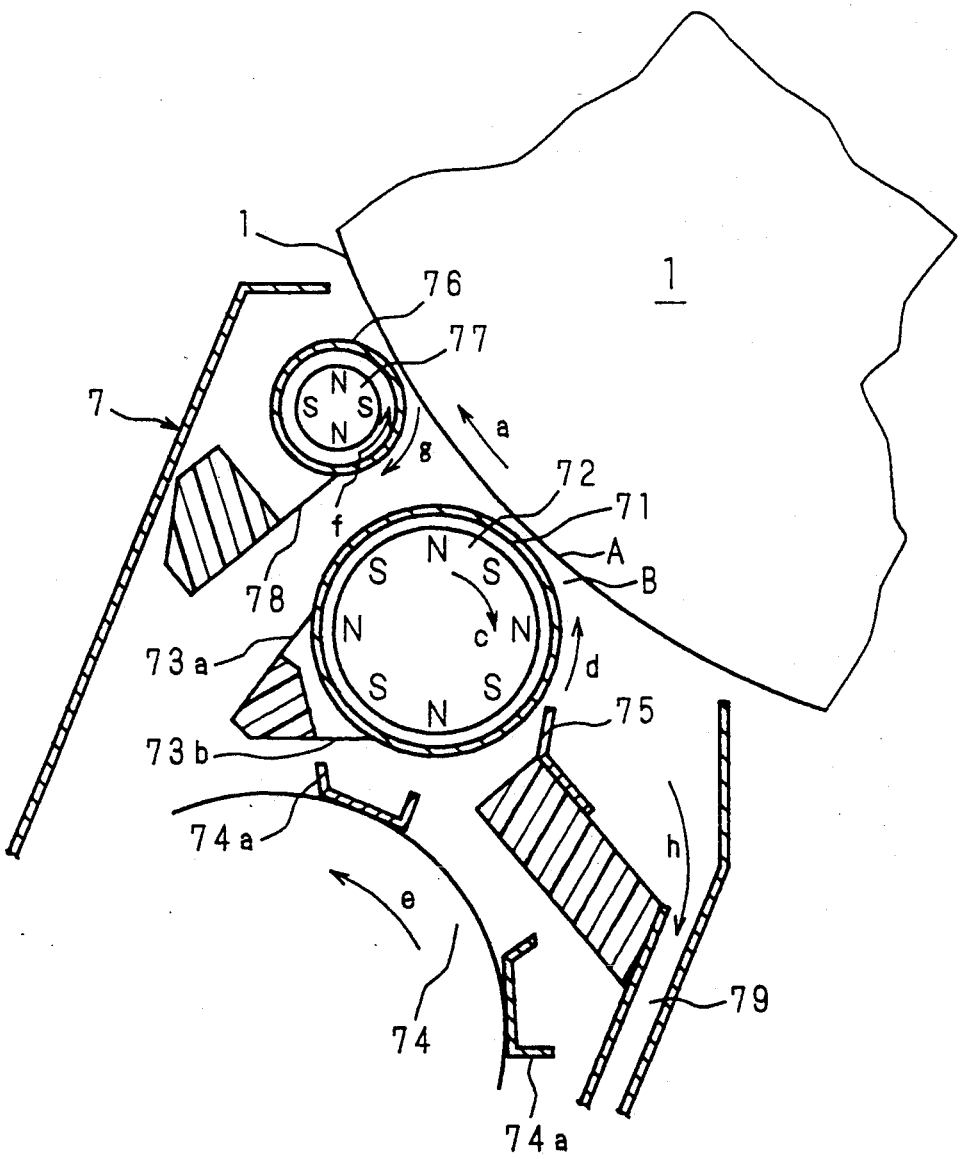
FIG. 3 is a sectional view of essential portions showing a structure of a second developing unit.

FIG. 3 is a sectional view of essential portions showing a structure of the second developing unit 7.

As shown in FIG. 3, the second developing unit 7 comprises, a developing sleeve 71 with a built-in magnetic roller 72 onto which N and S poles are magnetized sequentially in a circumferential direction, and tips of the scrapers 73*a*, 73*b* are pressed against a peripheral surface of the developing sleeve 71.

In the vicinity of the developing sleeve 71, a bucket roller 74 provided with buckets 74*a* is disposed rotatably in a direction of an arrow e. Meanwhile, adjacent to the developing sleeve 71, a developing agent guide plate 75, a carrier recovery roller 76 and a duct 79 are provided respectively. The carrier recovery roller 76 includes a magnetic roller 77 rotatably therein, and a tip of a scraper 78 is pressed against its peripheral surface. A dust collector including a suction fan, not shown, is connected to the duct 79.

The developing sleeve 71 and the magnetic roller 72 are rotated in a direction of an arrow c. Therefore, the developing agent is subjected to a transporting force in the direction c by the rotation of the developing sleeve 71, and at the same time, subjected to a transporting force in a direction of an arrow d by the rotation of the magnetic roller 72, and conveyed in the direction d along the periphery of the developing sleeve 71 by the difference of both the transporting forces.

That is, the developing agent supplied beneath the developing sleeve 71 by means of buckets 74 of the bucket roller 74 is conveyed in the direction d along the periphery of the developing sleeve 71 as aforementioned, and when passing through a developing area A, develops a second electrostatic latent image formed by the second optical system 6, and thereafter, a scraped off by the scraper 73*a*. The developing agent conveyed in the direction c by the developing sleeve 71 rotating in the same direction is scrapped off by the scraper 73*b*.

On the other hand, the carrier stuck to the surface of the photosensitive drum 1 is caught on the periphery of the carrier recovery roller 76 by a magnetic force of the magnetic roller 77 disposed rotatably in the carrier recovery roller 76, and by the magnetic roller 77 which rotates in synchronism in a direction of an arrow f by a magnetic force of the magnetic roller 72 in the developing sleeve 71, conveyed in a direction of an arrow g along the periphery of the carrier recovery roller 76 and scraped off by the scraper 78.

Next, the image control unit 22 will be explained with reference to FIG. 2.

The image control unit 22 has functions to produce a signal for forming a reference image for the toner replenishing control as well as produce a desired image signal by controlling the first and second driver circuits 32, 62. In the case where there is a portion where a first image and a second image are overlapped, it also includes image selecting means 20 which gives priority to the second image.

That is, a first image signal M1 and a second image signal M2 outputted from the CPU 21 consisting of a microcomputer are read respectively by a read circuit 23*a* and a read circuit 23*b*. At this time, in the case where an image priority signal (controlled by an operator) which gives priority to the second image is inputted by the image selecting mean 20, the image signals M1, M2 are compared in a comparison circuit 24, and a signal M' which samples the overlapped portion is inputted to an erase circuit 26 via a memory circuit 25. In the erase circuit 26, the overlapped portion signal M' is erased from the first image signal M1 and the rest is stored in a memory circuit 27*a*. The second image signal M2 is also stored intact in a memory circuit 27*b*. The image signals stored in the memory circuits 27*a*, 27*b* are read out by the driver circuits 32, 62, and transformed into the laser beam signals by the operation of the first and second LDs 31, 61.

Here, between the first driver circuit 32 (or the second driver circuit 62) and the memory circuit 27*a* (or 27*b*), a first dot counter 50 (or a second dot counter 51) for detecting the light emitting time of the first LD 31 (or second LD 61) is disposed, thereby the color toner (or black toner) consumption can be detected.

That is, the first dot counter 50 (or the second dot counter 51) counts the number of dots constituting an image formed within the light emitting time of the first LD 31 (or the second LD 61) per a given time, or within a fixed time, and the result of the counting is given to the CPU 21.

The laser beam signal transformed is scanned axially (main scanning direction) on the photosensitive drum 1 to form a negative latent image thereon.

Now, a sensor 33 is provided at a scanning start end of the first optical system 3 facing the photosensitive drum 1 (refer to FIG. 1). The sensor 33 serves to indicate the reading start time of the image to the driver circuits 32, 62, to which this indicating signal is outputted at the time point when the laser beam is emitted to the sensor 33. A delay circuit 28 is disposed between the sensor 33 and the second driver circuit 62, so that reading of the second image signal is started after a predetermined fixed time from the time of the indicating signal of the sensor 33. Here, the fixed time is the time during which the image-forming start point of the photosensitive drum 1 reaches a second exposure position from a first exposure position.

Meanwhile, in the case where the image priority signal is not outputted from the image selecting means 20, the first image signal M1 is stored intact in the memory circuit 27*a* without passing the comparison circuit 24.

In a reference image pattern circuit 29, a reference image pattern for controlling toner replenishing is stored. By controlling the first and second driver circuits 32, 62, each reference image pattern is read out from the reference image pattern circuit 29 for every image forming, and at one end portion outside the image forming portion of the photosensitive drum 1, first, respective reference image patterns for toner control of the first and second developing agents are formed discretely in the rotating direction as the reference images.

Respective reference images are developed reversely by the first and second developing units 4, 7 under the same condition as an image to be formed, and further, transferred onto the copying paper 16 together with the image to be formed, its density being detected by a density sensor 18 at a predetermined timing soon after the transfer. The density sensor 18 is an optical sensor consisting of a light emitting element and a light receiving element, thereby the amount of toner stuck to the reference image is detected as the reflection density. This detected value is compared with the reference reflection density of the case where the toner concentration of the developing agent in the developing units 4, 7 is at a set value in the toner replenishing control circuit 19.

In the case where the detected reflection density is lower than the reference reflection density, a toner replenishing signal is outputted from the toner replenishing control circuit 19. Thereby, the first and second toner replenishing means 42, 43 are operated to replenish a predetermined amount of toner into the developing agent of the first and second developing units 4, 7.

Figure 4:
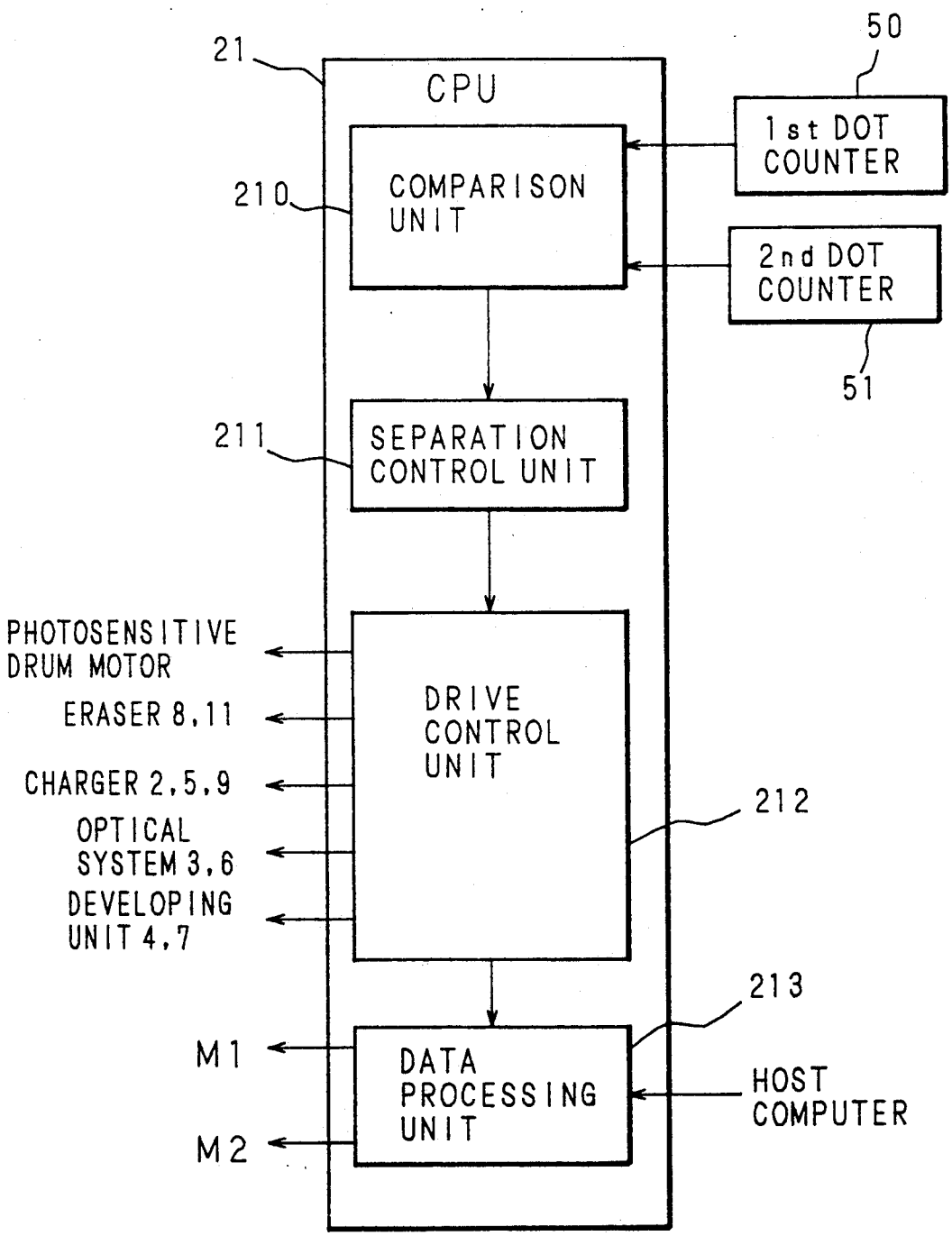
FIG. 4 is a block diagram showing a configuration of a CPU, FIGS. 5(*a*) and 5(*b*) are flow charts showing control contents of a main routine of a CPU, FIGS. 6(*a*) through 6(*b*) are views showing an operation at printing.

FIG. 4 is a block diagram showing a schematic configuration of the CPU 21.

The light emitting times of the first and second LDs 31, 61 counted by the first and second dot counters 50, 51 are given to a comparison unit 210 in the CPU 21, wherein the light emitting time of the first LD 31 and a predetermined value, and the two light emitting times are compared. Signals of the two results of the comparisons are given to a separation control unit 211, and in the case where the light emitting time of the first LD 31 is longer than the predetermined value, a separation signal indicating the fact is given to a driving control unit 212 so as to move to a separation mode to be described later. The operating time of the separation mode is decided by the difference in light emitting times of the two LDs 31, 61.

The driving control unit 212 is designed to drive and control the photosensitive drum 1 and its peripheral equipments, thus when the separation signal is received, drives the photosensitive drum motor, first and second chargers 2, 5 and second developing unit 7 ON and OFF.

The CPU 21 receives a control signal and an image signal given from a host computer, not shown, and in a data processing unit 213, processes the control signal to send it to the driving control unit 212, and processes the image signal to output the first and second image signals M1, M2.

Figure 5A:
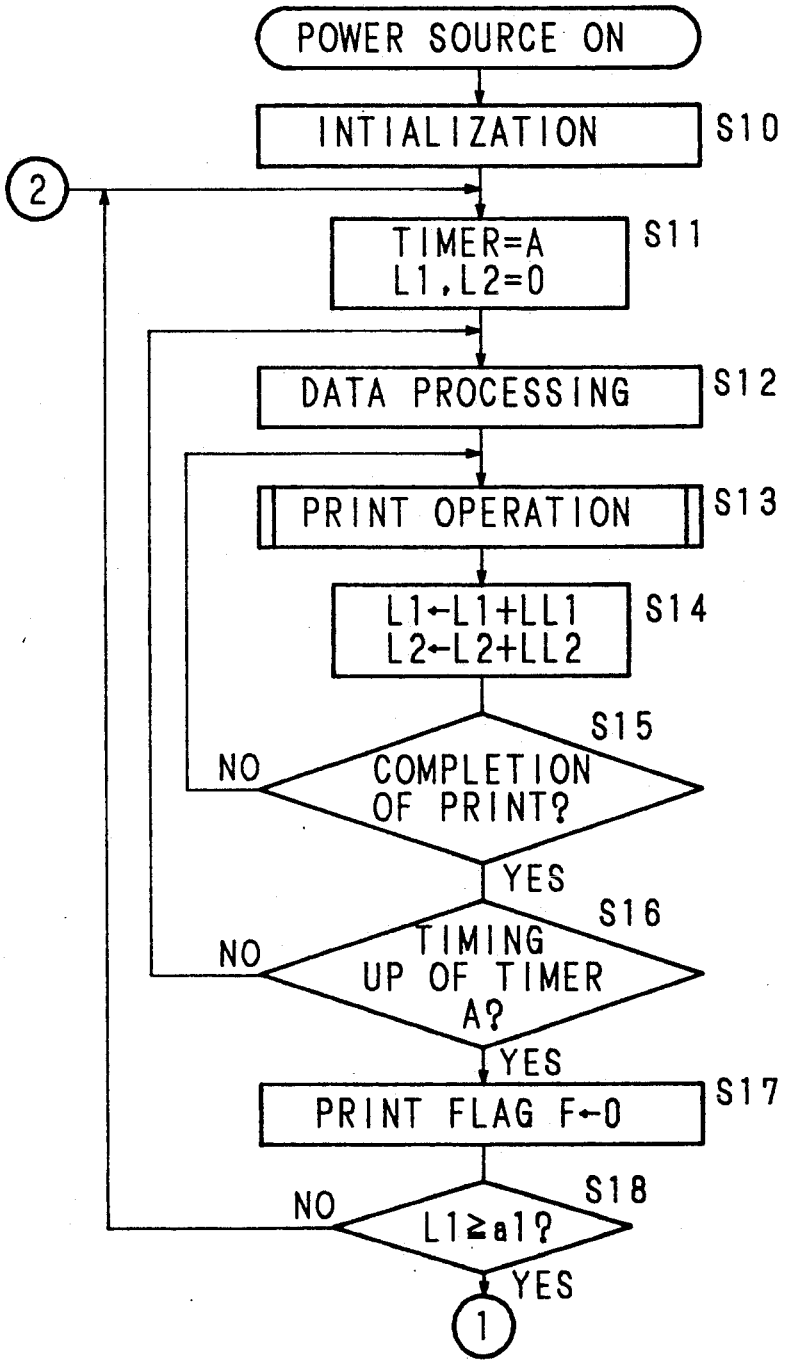
Figure 5B:
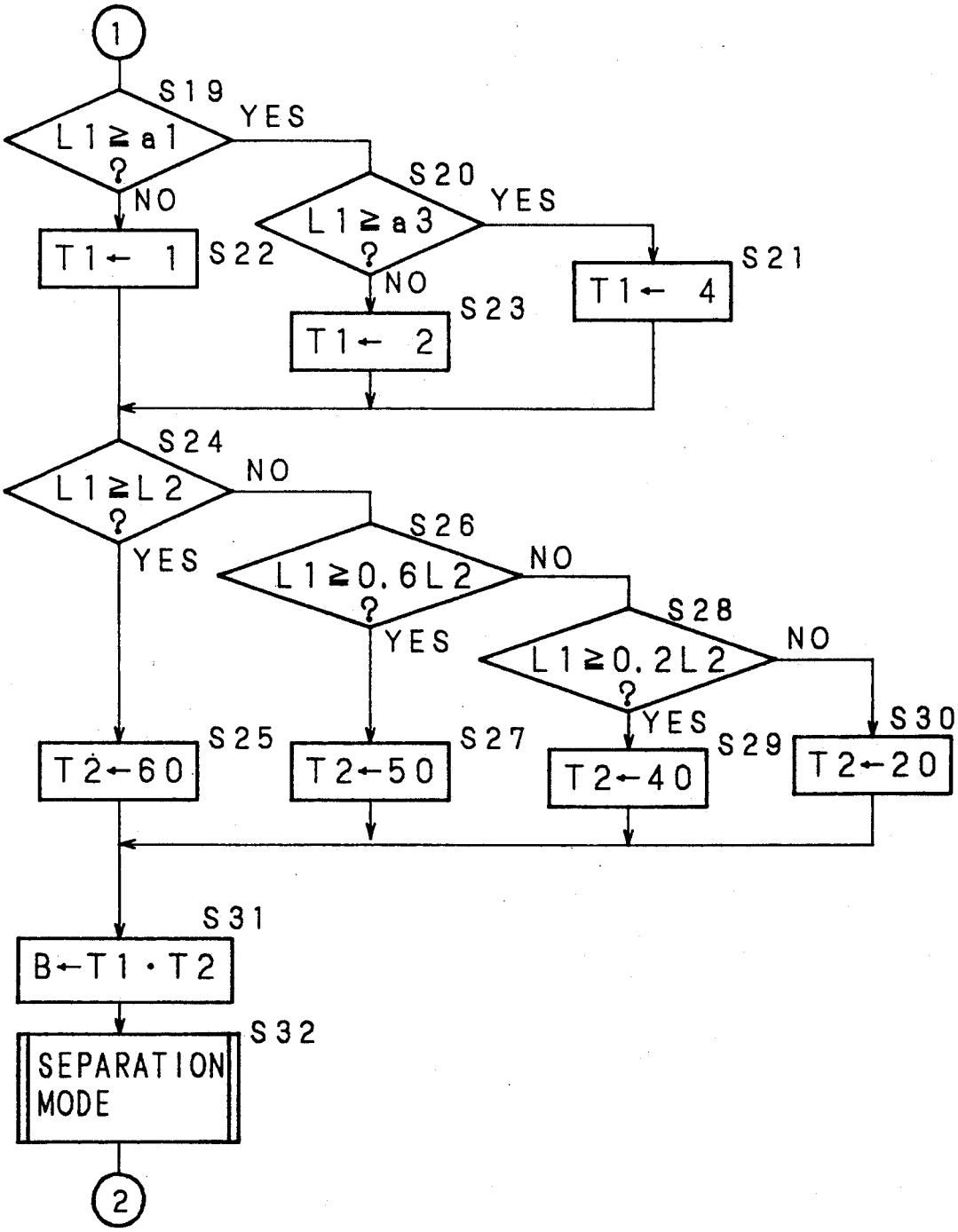

Next, the operation of the image forming apparatus of the present invention will be described. FIG. 5(*a*) and FIG. 5(*b*) are flow charts showing control contents of the CPU 21.

First, when a power supply is turned on, initial setting processing for initializing the contents of registers, counters and so on in a RAM, ROM and CPU 21, not shown, is executed (Step S10). Then, a timer for fixing the print operation time is set to the time A, and the light emitting times of the first and second LDs 31, 61, or count values L1, L2 of the first and second dot counters are reset (Step S11).

Next, data processing takes place between the CPU 21 and the host computer (Step S12). The CPU 21 receives the control signal and image signal from the host computer, and performs the print operation in response thereto (Step S13). Moreover, the CPU 21 adds count values LL1, LL2 indicating the light emitting time of the first and second LDs 31, 61 at the printing operation to the count values L1, L2 to execute accumulative processing of the count values L1, L2 (Step S14).

The accumulative processing is carried out to add the light emitting times of the first and second LDs 31, 61 for every printing operation, and to calculate a total toner consumption in response to these added values.

Figures 6A, 6B, 6C, 6D, 6E, 6F:
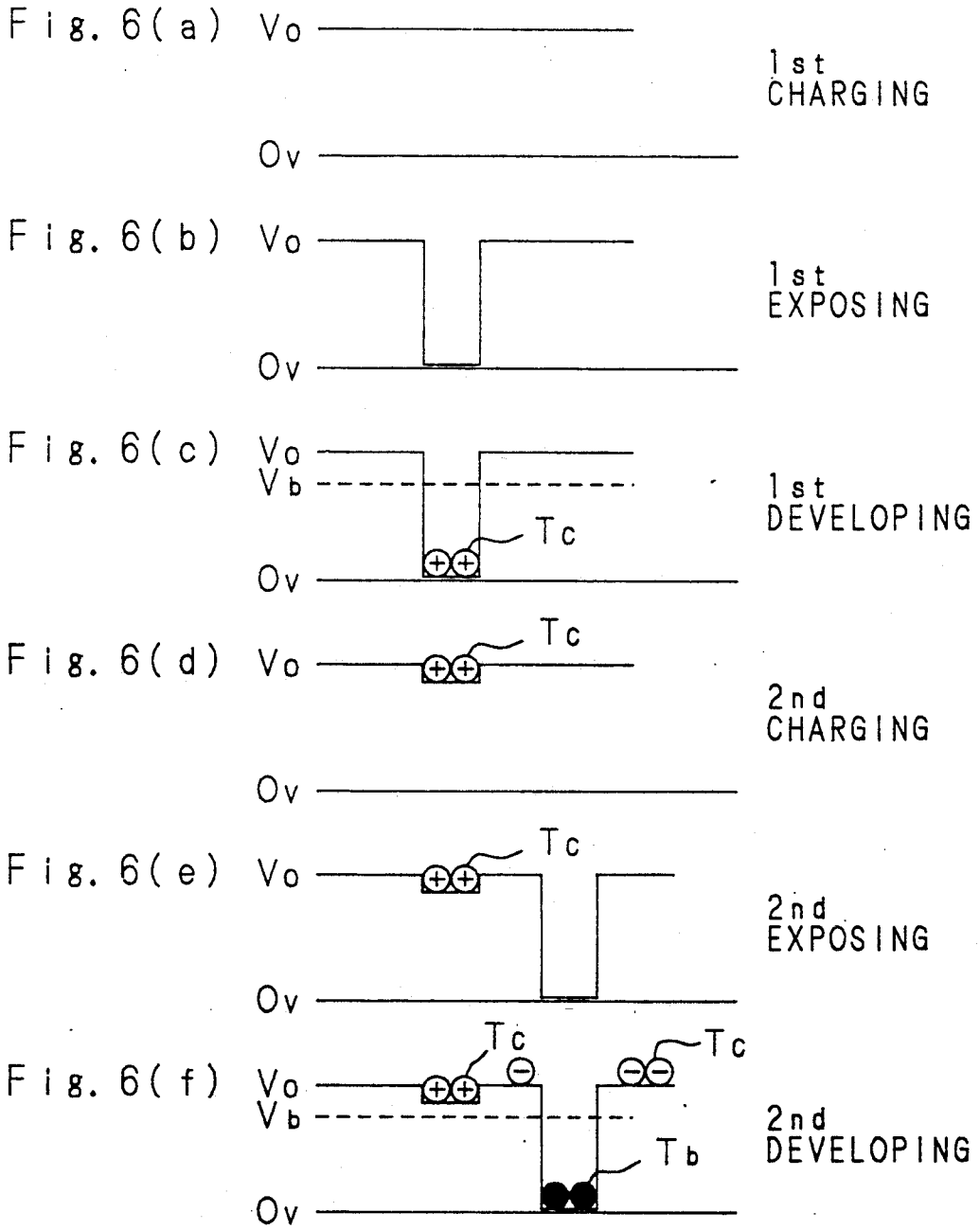

The print operation is as shown in FIG. 6(*a*) to FIG. 6(*f*).

That is, as shown in FIG. 6(*a*), in the rotating state of the photosensitive drum 1 at fixed speed in a direction of an arrow a, first, a first charging is effected by the first charger 2 to charge the surface of the photosensitive drum 1 with a potential $V_0$.

Next, as shown in FIG. 6(*b*), a first exposure is effected by the first optical system 3, whereby a potential of the image portion is reduced to about 0 V, and a negative electrostatic latent image of such an image as ruled lines, for example, is formed.

Then, as shown in FIG. 6(*c*), a first development is effected by the first developing unit 4. This development is carried out while applying a developing bias voltage Vb on the developing sleeve 41, therefore it is an reversal development wherein a color toner Tc charged in positive polarity sticks to the image portion (charge-erased portion).

Next, as shown in FIG. 6(*d*), a second charging is effected by the second charger 5, and the surface of the photosensitive drum 1 is substantially returned to the potential $V_0$.

Successively, as shown in FIG. 6(*e*), a second exposure is effected by the second optical system 6, whereby a potential of the image portion is reduced to about 0 V, and a negative electrostatic latent image of such an image as a character in ruled lines, for example, is formed.

Then, as shown in FIG. 6(*f*), a second development is carried out by the second developing unit 7. This development is performed while applying the developing bias voltage Vb on the developing sleeve 71, therefore it is an reversal development wherein a black toner Tb charged in positive polarity sticks to the image portion (charge-erased portion), and a second image is overlapped on a first image.

At this time, the color toner Tc mixed into the second developing unit 7 is contacted with the black toner Tb and friction-charged in negative polarity. This charge polarity is in opposite polarity (negative polarity) to the charge polarity (positive polarity) of the surface of the photosensitive drum 1. Accordingly, the color toner Tc charged in negative polarity is stuck to an image background of a charge potential $V_0$ at second development, and since the transfer charger is in same polarity (negative polarity), it is removed from the surface of the photosensitive drum 1 by the cleaner 10 without being transferred onto the copying paper 16.

On the other hand, the copying paper 16 is conveyed in a direction of an arrow b on a passage indicated by one-dot-chain lines in FIG. 1 as continuous forms paper, and onto which the toners Tc, Tb are transferred by the negative discharge of the transfer charger 9, thereafter, the toners Tc, Tb are fused and fixed by a fixing device, not shown. Thereby, the print operation is completed.

Charges on the photosensitive drum 1 are erased by the eraser lamp 8 immediately before the transfer processing.

The photosensitive drum 1 continues to rotate in the direction of the arrow a even after the transfer, and the residual toner is removed by the cleaner 10 and the residual charge is erased by the main eraser lamp 11.

Figure 7:
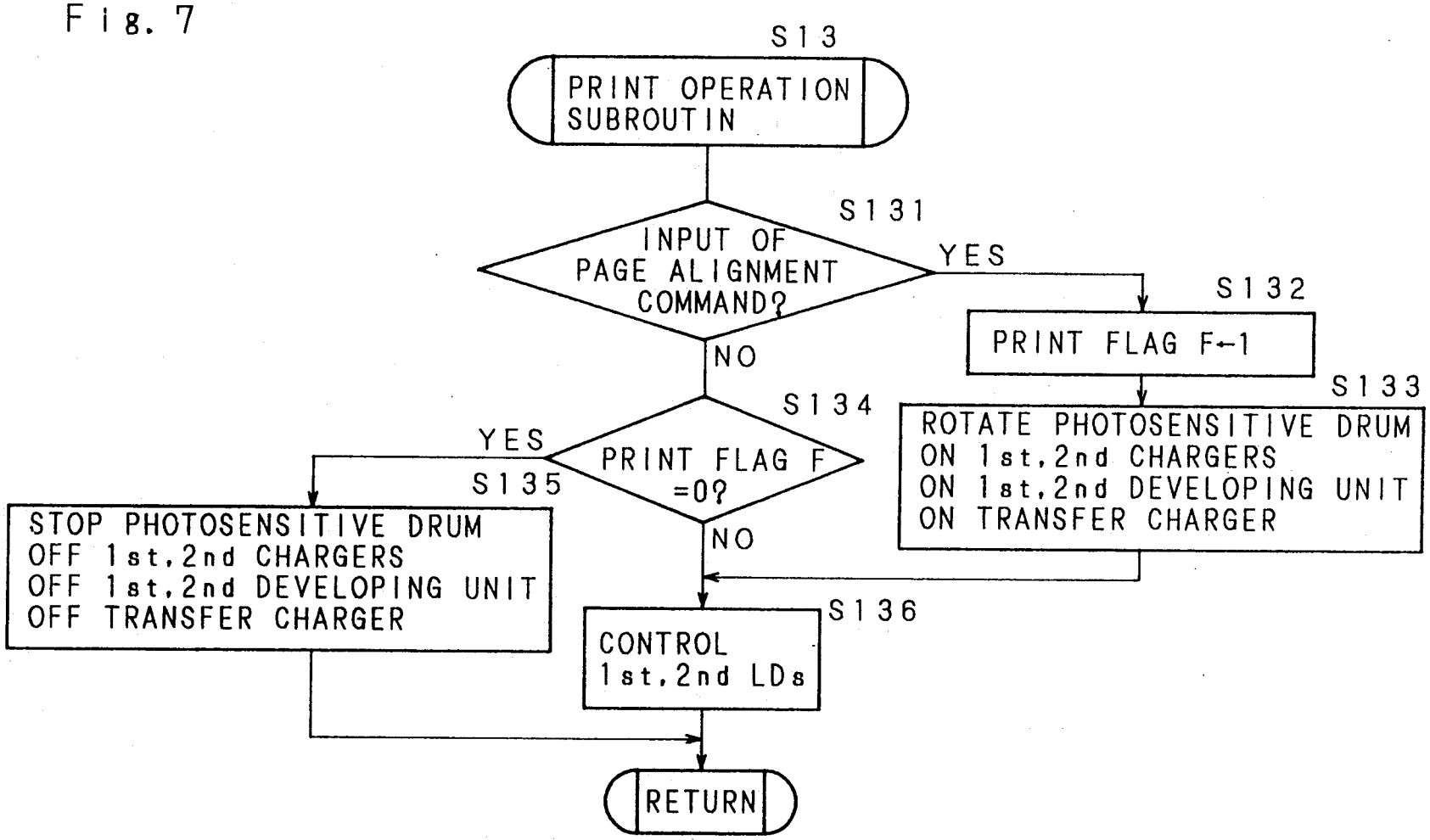
FIG. 7 is a flow chart of a printing operation.

Processing contents of the print operation are as shown in a flow chart of FIG. 7.

First, the presence or absence of input of a page alignment command is judged (Step S131), and in the case where the page alignment command is inputted, a print flag F is set to "1" and the photosensitive drum 1 is rotated. The first and second chargers 2, 5, first and second developing units 4, 7 and further, the transfer charger 9 are turned on (Step S133), then the first and second LDs 31, 61 are controlled for usual print operation (Step S136), and the processing returns to a main routine.

In the case where the page alignment command is not inputted, each of the equipments turned on in Step S133 is turned off (Step S135) and the processing returns to the main routine.

When the accumulative processing is completed, it is judged in Step S15 whether the print operation is completed or not. In the case where the print operation is not completed, the processing returns to Step S13 to continue the printing operation. In the case where the print operation is completed, after waiting a timing up of a timer A (Step S16), the print flag F is set to "0" (Step S17), and the accumulated count value L1 and a first given value a1 are compared with each other (Step S18).

In the Step S18, in the case where the count value L1 is smaller than the first given value a1 ($L1<a1$), it is judged that the color toner is still not consumed much and the mixed-color amount is within a tolerable level, and the processing returns to Step S11. In the case where the count value L1 is same as the first given value a1 or more ($L1 \geqq a1$), the count value L1 and a second given value a2 are compared with each other (Step S19). When the result is $L1 \geqq a2$, further the count value L1 is compared with a third given value a3 (Step S20).

In such a manner, the count value L1 is compared respectively with the given values a1, a2 and a3, and in the case of $a1 \leqq L1 < a2$, a factor T1 deciding a timer value B to be described later is set to "1" (Step S22), in the case of $a2 \leqq L1 < a3$, the factor T1 is set to "2" (Step S23), and in the case of $L1 \geqq a3$ the factor T1 is set to "4" (Step S21).

Next, the count value L1 is compared with the count value L2 (Step S24), a reference value T2 of the timing value B of the timer is decided according to the magnitudes and degree thereof. In the case where the count value L1 is larger than that L2, that is, the consumption of color toner is larger than that of block toner, the reference value T2 is set to 60 seconds.

In the case of $L1<L2$, whether or not $L1 \geqq 0.6L2$ is judged next (Step S26), and in the case of $L1<0.6L2$, further, it is judged whether or not $L1 \geqq 0.2L2$ (Step S28). That is, by each of these steps S24, S26 and S28, the difference of the magnitude between the count values L1 and L2 is judged in four steps. As the result, in the case of $0.6L2 \leqq L1 < L2$, the reference value T2 is set to 50 seconds, (Step S27), in the case of $0.2L2 \leqq L1 < 0.6L2$, T2 is set to 40 and in the case of $L1 < 0.2L2$, T2 is set to 20 respectively (Step S29, S30).

Then, the factor T1 and the reference value T2 set are multiplied to obtain the timer value B (Step S31), and thereafter the processing moves to the separation mode (Step S32).

Figure 8:
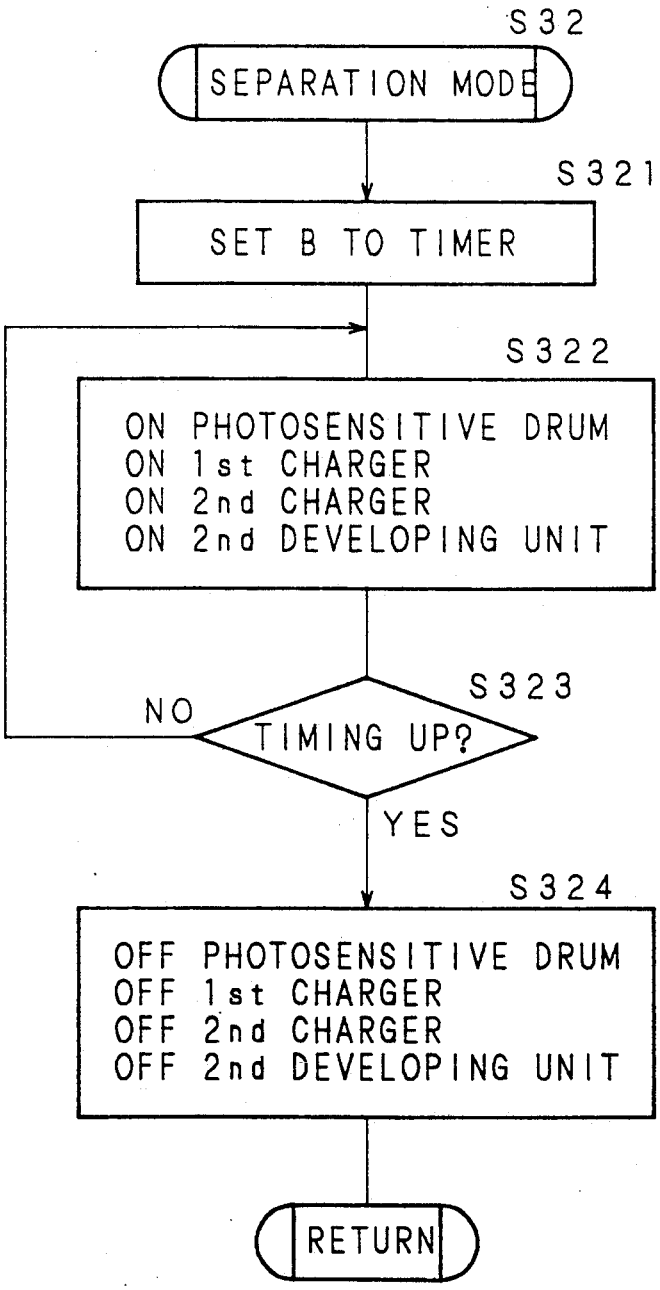
FIG. 8 is a flow chart showing processing contents of a separation mode.

FIG. 8 is a flow chart showing processing contents of the separation mode.

In the separation mode, the timer value B deciding a separation time is, first, set to the value $T1 \times T2$ previously obtained (Step S321). Then the photosensitive drum 1, first and second chargers 2, 5 and second developing unit 7 are turned on to be driven respectively. Thereby, the negative color toner mixed into the second developing unit 7 is stuck to the surface of the photosensitive drum 1 and removed from the second developing unit 7 (Step S322).

On the other hand, a part of the color toner mixed into the second developing unit 7 may be sometimes destaticized by contacting with the carrier. Such color toner whose charged capacity is destaticized substantially to zero is apt to change into a powder smoke, and specifically, changes into the powder smoke at area B on the upstream side in a transporting direction of the developing agent of the developing area A. The toner powder smoke is collected and removed through the duct 79 in the second developing unit 7 kept in negative pressure by a suction fan.

Then, after the timing up of the timer (Step S323) set previously in Step S321, each of the equipments turned on in Step S322 is turned off (Step S324), and the processing returns to the main routine.

After returning to the main routine, the processing returns to Step S11 and moves to the next image processing.

In this embodiment, though consumptions of the color toner and the black toner are detected by count values of the dot counter which counts the light emitting times of the first and second laser diodes, the present invention is not limited thereto. For example, the consumption of the color toner and black toner may be detected by the replenishing time or replenishing frequency of the color and black toners of the first and second developing unit toner replenishing means.

Also, in this embodiment, though the number of dots constituting an image formed within a fixed time is counted by the dot counter, and thereby detecting the color toner consumption, the present invention is not limited thereto. For example, the color toner consumption may be detected by carrying out various operations based on the count values of the dot counter.

As described heretofore, in the present invention, it is so constructed that values related to consumption of the first and second developing agents are detected at completion of every image forming operation, for example, by counting the number of dots and by the toner replenishing amount or frequency, and when the consumption of the first developing agent exceeds a predetermined value, the control is automatically shifted to the mixed-color separating operation from the image forming operation, and at the same time, the mixed-color separating operation time is decided in response to the two values so as to remove the first developing agent mixed into the second developing means. Thereby, responsive to the amount of first developing agent mixed into the second developing agent, mixed-color separation is effected adequately, thus the present invention is very effective in obtaining always a clear two-color image with little mixed-color.

A second embodiment of the invention will now be described with reference to the accompanying drawings.

Figure 9:
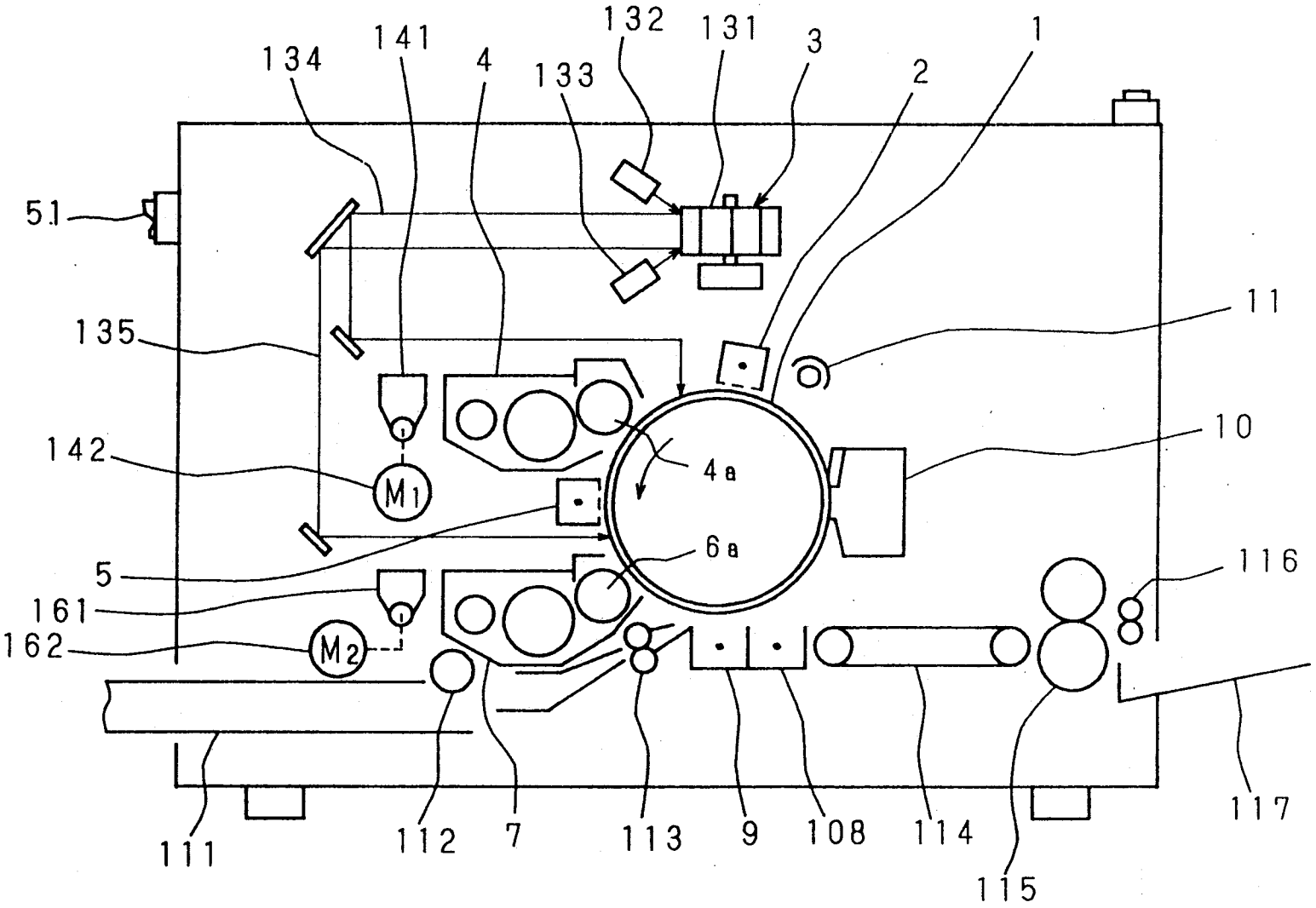
FIG. 9 is a sectional view showing a schematic configuration of essential portions of a second embodiment of a two-color printer which is an image forming apparatus according to the present invention.

FIG. 9 shows a section of an electrophotographic printer including a photosensitive drum 1 disposed generally centrally thereof, and a first charger 2, a first developing unit 4, a second charger 5, a second developing unit 7, a transfer charger 9, a separating charger 108, a cleaner 10, and an eraser 11 which are arranged around the photosensitive drum 1.

Disposed above the photosensitive drum 1 is an optical system 3 including a polygonal scanner 131, and a first laser head 132 and a second laser head 133 which respectively project laser beams 134, 135 onto the scanner 131 in corresponding relation to individual images. At left-hand side of the transfer charger 9 there are arranged, as shown, a cassette 111 holding copying papers as a transfer or recording medium, a feed roller for feeding copying papers from the cassette 111, and timing rollers 113 for supplying each copying paper fed from the cassette 111 onto a surface of the photosensitive drum 1 which is opposite to the transfer charger 9 in synchronous relation to forming a toner image on the drum 1. At right-hand side of the separating charger 108 there are arranged, as shown, a belt 114 for conveying each copy paper on which a toner image has been transferred, a fusing device 115 for fusing the transferred toner image to the copying paper, discharge rollers 116, and a paper receiving tray 117.

The first developing unit 4 is of the so-called magnetic brush type having a developing roller 4*a* which is positioned in opposed relation to the photosensitive drum 1 and comprises a stationary magnetic roll and a sleeve adapted for rotation thereabout. The first developing unit 4 holds therein a first developing agent of the two-component type which is composed of a toner and a carrier, the carrier being a spherical ferrite carrier is used, the toner being a non-magnetic red toner. The developing agent is such that through friction contact of the two components, the carrier is charged with a positive charge and the toner is charged with a negative charge. There is provided, in association with the first developing unit 4, a toner hopper 141 containing additional supply of red toner which is driven by a motor 142 to supply red toner to the first developing unit 4.

Figure 10:
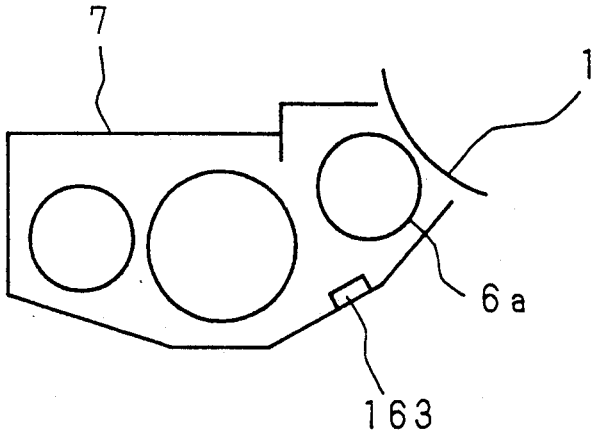
FIG. 10 is a schematic sectional view showing a more detailed configuration of the developing unit and a position where a mixed amount detecting sensor is disposed.

Similarly, the second developing unit 7 is of the so-called magnetic brush type having a developing roller 6*a* which is positioned in opposed relation to the photosensitive drum 1 and comprises a stationary magnetic roll and a sleeve adapted for rotation thereabout. In the second developing unit 7, a second developing agent of the two-component type which is composed of a toner and a carrier is used, the carrier being a binder type carrier, the toner being a magnetic black toner. The developing agent is such that through friction contact of the two components, the carrier is charged with a positive charge and the toner is charged with a negative charge. There is provided, in association with the second developing unit 7, a toner hopper 161 containing additional supply of black toner which is driven by a motor 162 to supply black toner to the second developing unit 7. Further, the second developing unit 7 is provided with an optical sensor 163 for detecting the degree of color mixture of the second developing agent, as shown in FIG. 10.

Figure 11:
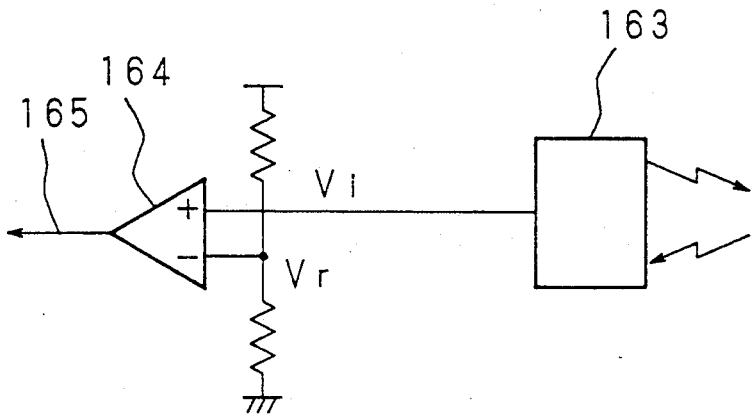
FIG. 11 is a circuit diagram showing a circuit configuration of the mixed amount detecting sensor.
Figure 12:
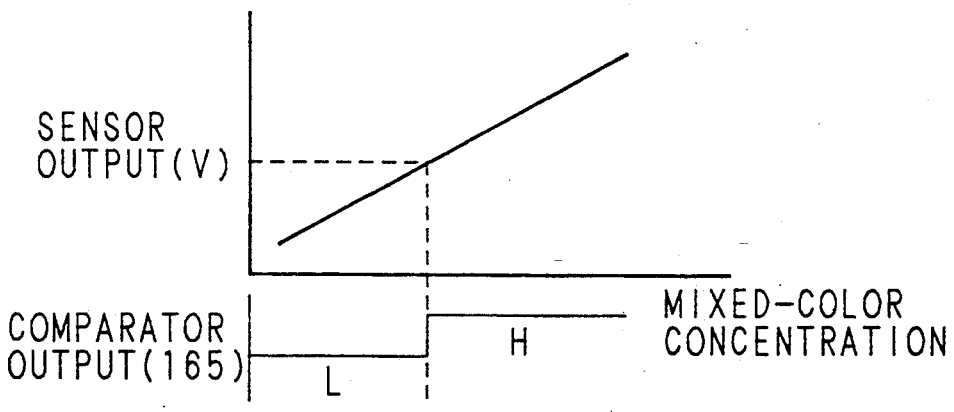
FIG. 12 is a graph showing the relationship between a toner mixed-color concentration, mixed amount detecting sensor output and its comparator output.

The sensor 163, as FIG. 11 shows, illuminates the second developing agent and detects light reflected therefrom, and inputs a signal of voltage Vi corresponding to the detected light to a comparing input terminal of a comparator 164. To a reference input terminal of the comparator 164 is inputted a signal of reference voltage Vr corresponding to the limit of color mixture, that is, the degree of color mixture such that a further progress of color mixing will enable clear recognition of the color mixture with respect to a developed image. The comparator 164 compares the two signals with each other and outputs a signal 165 corresponding to the result of comparison with respect to Vi and Vr. As FIG. 12 shows, signal 165 is given as an "H" signal in the case where $Vi > Vr$, or in the case where the degree of color mixture of the second developing agent exceeds the limit of color mixture, and conversely, in the case where $Vi < Vr$, or in the case where the degree of color mixture of the second developing agent is lower than the lower limit of color mixture, it is given as an "L" signal.

Figure 13:
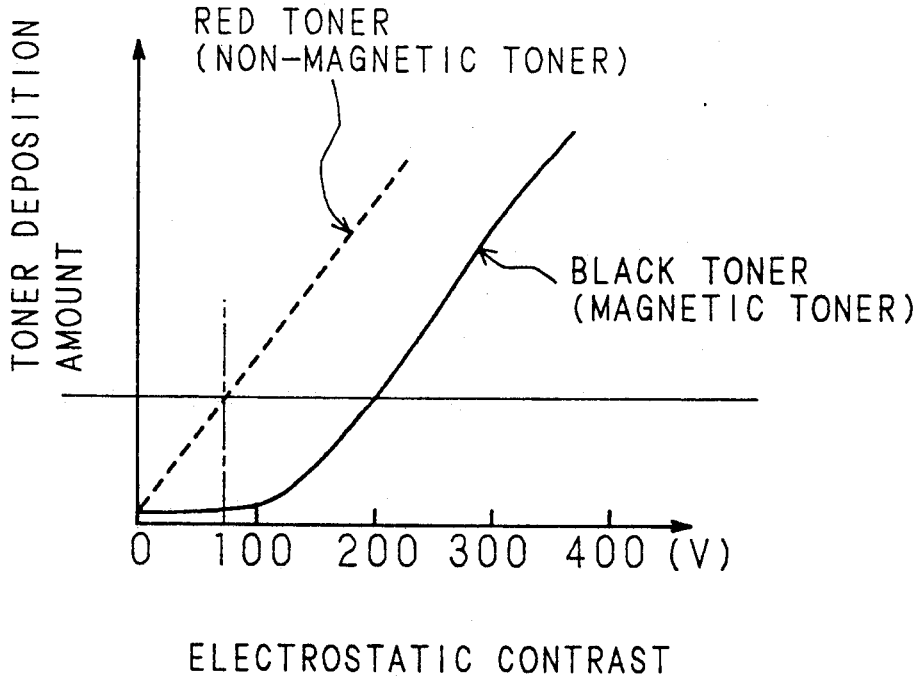
FIG. 13 is a graph showing development characteristics of a toner used in an image forming apparatus of the embodiment.

FIG. 13 graphically shows the relationship of the amounts of deposit on the photosensitive drum 1 of non-magnetic red toner in the first developing agent in the first developing unit 4 and magnetic black toner in the second developing agent in the second developing unit 7 with electrostatic contrast (V). It is noted that the term "electrostatic contrast" herein refers to a voltage contributive to the deposition of the toners onto the photosensitive drum 1.

As may be clearly seen from FIG. 13, the amount of red toner deposition increases in proportion as the voltage in electrostatic contrast increases from a value close to 0 (V), as shown by the dotted line, whereas the magnetic black toner is little deposited on the photosensitive drum 1 at the electrostatic contrast level of 70 (V) (indicated by P), the amount of magnetic black toner deposition increasing as the voltage in electrostatic contrast increases from the level of about 100 (V). In other words, with the magnetic black toner, development is possible in the case where the voltage in electrostatic contrast is about 100 (V) or above, while with the non-magnetic red toner, development is possible at a lower voltage.

Figure 14:
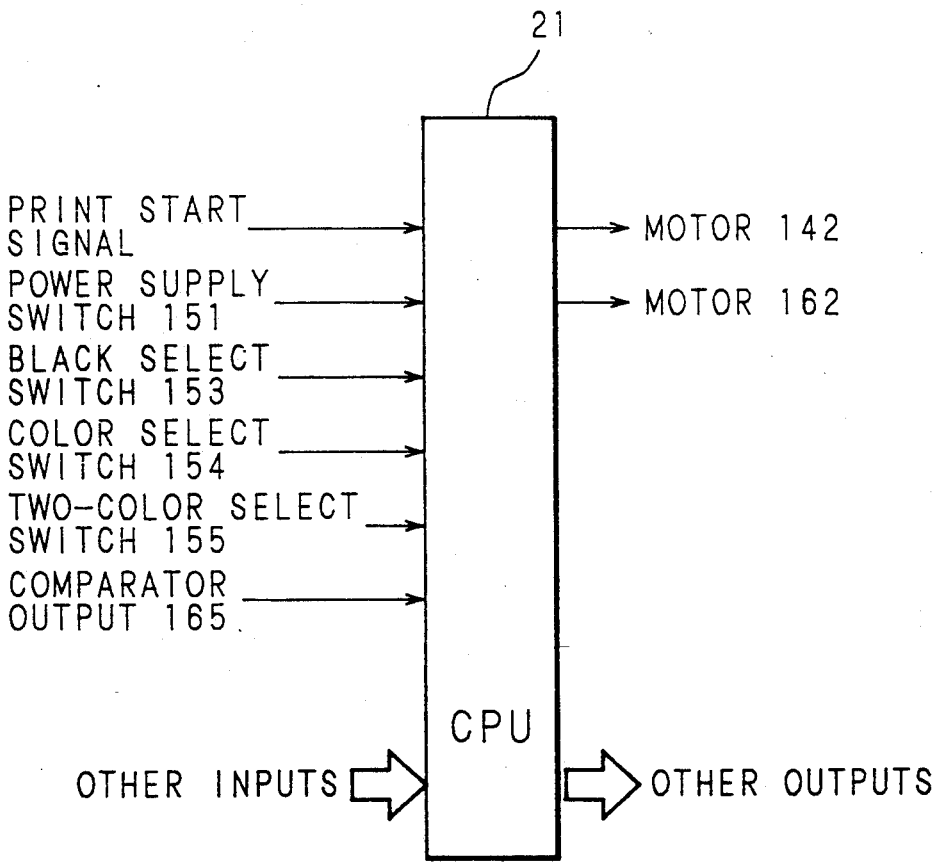
FIG. 14 is a schematic view showing input/output signals to a central processing unit (CPU) of an image forming apparatus of the embodiment.

FIG. 14 is a schematic diagram showing some typical input and output signals to and from a control circuit of the image forming apparatus. A central processing unit (CPU) 21 receives a print start signal from other input device, and also receives signals respectively from a power supply switch 151, a black select switch 153 for selecting a black print mode in which a black monochromatic image is formed, a color select switch 154 for selecting a color print mode in which a color (red) monochromatic image is formed, and a two-color select switch 155 for selecting a two-color print mode in which a two-color image in black and color is formed, and a comparator output 165. The CPU 21 outputs remote signals for driving the toner supply motors 142, 162. It is noted that the CPU 21 also outputs remote signals to the photosensitive drum 1, chargers 2, 5, 9, 108, developing units 4, 7, and eraser 11.

The process of two-color image forming by the printer will now be described.

The photosensitive drum 1 rotates counterclockwise as shown in FIG. 9 and is uniformly charged over its outer periphery by the first charger 2. Then, the first laser head 132 of the optical system 3 emits a laser beam 134 in response to the red image, and the laser beam 134 reflected from the scanner 131 is exposed to the photosensitive drum 1 to form a first latent image, which is in turn developed by the red toner in the first developing unit 4. Subsequently, the outer periphery of the photosensitive drum 1 is again uniformly charged by the second charger 5. The second laser head 133 emits a laser beam 135 in response to the black image, and the laser beam 135 reflected from the scanner 131 is exposed to the photosensitive drum 1 to form a second latent image, which is in turn developed by the black toner in the second developing unit 7.

Copying papers are each fed from the cassette 111 by the feed roller 112, and each copying paper is supplied by the timing rollers 113 into the gap between the photosensitive drum 1 and the transfer charger 9 in synchronous relation with the formation of a toner image on the photosensitive drum 1. Then, a black toner image and a red toner image are transferred to the copying paper under discharge from the transfer charger 9. The copying paper to which the toner images have been transferred is separated from the outer periphery of the photosensitive drum 1 by the separating charger 108 and is then delivered by the belt 114 to the fusing device 115 for toner image fusion. After the toner image is fused, the copying paper is delivered by the discharge rollers 116 into the paper receiving tray 117. The photosensitive drum 1, from which the toner images have been transferred, is removed of any residual toner by the cleaner 10 and then an residual charge thereon is erased by the eraser 11. Thereafter, the photosensitive drum 1 is moved back to its initial position which is opposite to the first charger 2.

Relative potential levels for two-color image forming are specifically set as follows:

| | | |
|---|---|---|
| a) | Photosensitive surface potential charged by the first charger 2 | −600 (V) |
| b) | Exposed surface potential after first exposure | −50 (V) |
| c) | Developing bias voltage at first developing unit 4 | −450 (V) |
| d) | Photosensitive surface potential charged by the second charger 5 | −700 (V) |
| e) | Exposed surface potential after second exposure | −60 (V) |
| f) | Developing bias voltage at second developing unit 7 | −550 (V) |

In the foregoing voltage settings, the voltage in electrostatic contrast, 490 V (=550−60), for black toner development is greater than the voltage in electrostatic contrast for red toner development, 400 V (=450−50), because the black toner is a magnetic toner which is oriented toward the developing roller 6a under a force of magnetic constraint, and accordingly because by increasing the voltage in electrostatic contrast, it is intended that the electrostatic suction force of the black toner relative to the photosensitive drum 1 be increased to obtain a moderate image density.

In the process of two-color image forming, the magnetic brush of the second developing unit 7 goes in contact with the red toner deposited on the photosensitive drum 1, so that the red toner is scraped by the magnetic brush and thus the scraped red toner enters the second developing unit 7 to get mixed with the second developing agent little by little to be accumulated therein. However, it is noted that both the red and black toners used in the image forming apparatus become charged on the negative side relative to the carrier and, therefore, that the black toner and the red toner which has become mixed therewith are little liable to become charged and the both will be negatively charged relative to the carrier to be adhered thereto. Therefore, it is unlikely that the charge polarity of the red toner which has become mixed in the second developing agent will be reversed to cause the red toner to fly away in dust form.

Conditions setting and operation for a separation mode in which the red toner which has become mixed in the second developing agent is separated and collected will be explained.

In the separation mode, the photosensitive drum 1 is driven and, in addition, the first charger 2 and second developing unit 7 are driven, while other peripheral devices, such as the first developing unit 4, second charger 5, transfer charger 9, separating charger 108, eraser 11, and optical system 3, are kept in non-operative condition. Relative potential settings in the separation mode are as follows:

| | | |
|---|---|---|
| a) | Photosensitive surface potential charged by the first charger | −600 (V) |
| b) | Developing bias potential in the second developing unit 7 | −670 (V) |

Therefore, during the execution of the separation mode, the photosensitive drum 1 is charged to −600 (V) on its outer peripheral surface by the first charger 2, and is rotated until the charged surface reaches a position opposite to the second developing unit 7. At the second developing unit 7, wherein the developing bias voltage is set at −670 (V), an electrostatic contrast corresponding to the balance of 70 (V) develops. The red toner which has mixed into the second developing unit 7 is deposited on the photosensitive drum 1 in response to such electrostatic contrast. The electrostatic contrast of 70 (V) is short of the voltage required for development of the magnetic black toner, as may be seen from the developing characteristics of the black toner in FIG. 13, and as a rule there is no possibility of the black toner depositing on the photosensitive drum 1. Thus, the red toner which has become mixed into the second developing agent is selectively separated to be deposited on the photosensitive drum 1 and is collected into the cleaner 10.

As described above, it is possible, as a matter of principle, to selectively separate and collect only the red toner, and not the black toner, from the second developing unit 7. In actuality, however, the red toner so collected contains some black toner. Further, changes in environmental conditions may lead to changes in the static characteristics of toners and, therefore, in the case where separation and collection of the red toner is carried out when the proportion of the red toner is relatively small, there may be an increase in the amount of black toner collected. Therefore, in the image forming apparatus according to the invention, wherein the red toner amount mixed into the second developing unit 7 increases in proportion as the consumption of the red toner increases, the consumption of red toner, that is, the number of times of red toner supply into the first developing unit 4 is measured and, on the basis of the result of such measurement, operation of the separation mode is carried out.

The method of control and arrangement for this operation will now be described.

Figure 15:
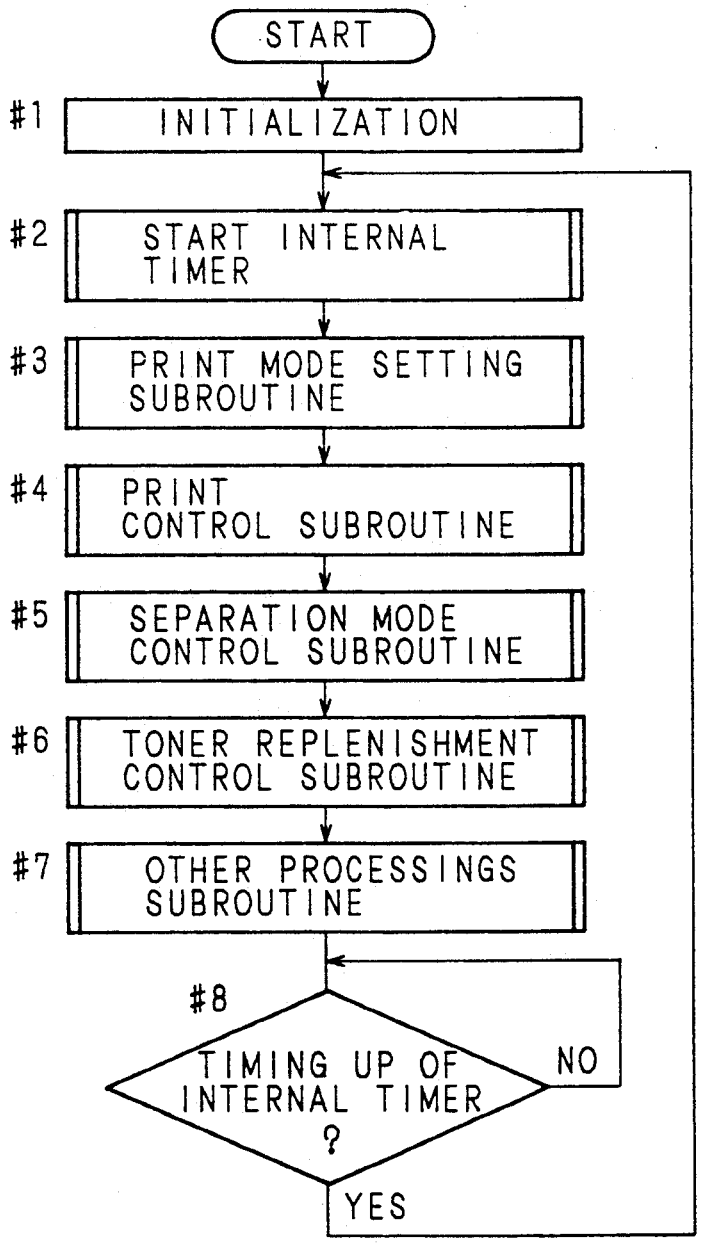
FIG. 15 is a flow chart showing contents of a main routine of a CPU.

FIG. 15 is a flow chart showing the details of a main routine of the CPU 21 for print control.

When the power switch 15 is turned on, the entire control circuit is initialized in step #1. Then, in step #2, an internal timer starts timing and, in steps #3 through #7, a print mode setting subroutine, a print control subroutine, a separation mode control subroutine, a toner replenishment control subroutine, and other processing subroutine are executed respectively. The print mode setting subroutine, print control subroutine, separation mode control subroutine, and toner supply control subroutine will be described in detail hereinafter. However, description of the other processing subroutine in step #7, which has no relation with the subject matter of the invention, is omitted. Subsequently, in step #8, decision is made as to whether or not the internal timer has terminated timing, and in the case of yes, the program will return to step #2 for repetition of similar processing.

Figure 16:
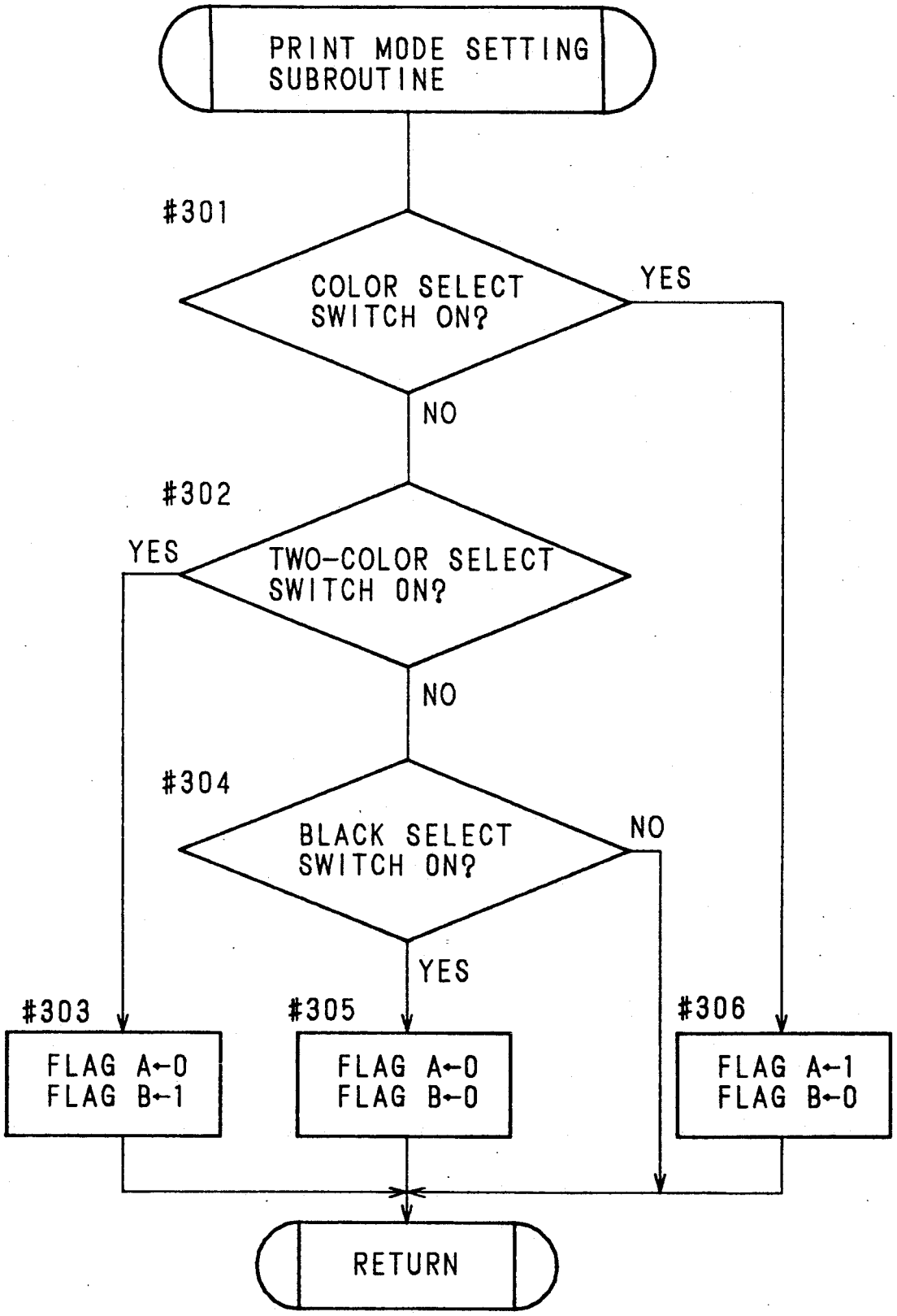
FIG. 16 is a flow chart showing contents of a print mode setting sub-routine.

FIG. 16 is a flow chart showing the details of the print mode setting subroutine.

In steps #301, #302 and #303, it is determined whether or not the color select switch 154, two-color select switch 155, and black select switch 153 have been respectively turned on. When the two-color select switch 155 has been turned on, flag A is set to "0", and flag B to "1", in step #303. When the black select switch 153 has been turned on, flags A and B are both set to "0" in step #305. When the color select switch 154 has been turned on, flag A is set to "1", and flag B to "0", in step #306. In the case where none of the switches 153, 154, 155 have been turned on, the program will return to the main routine. Thus, a print mode selected on the basis of the combination of flags A and B is determined (FIG. 17).

Figure 18:
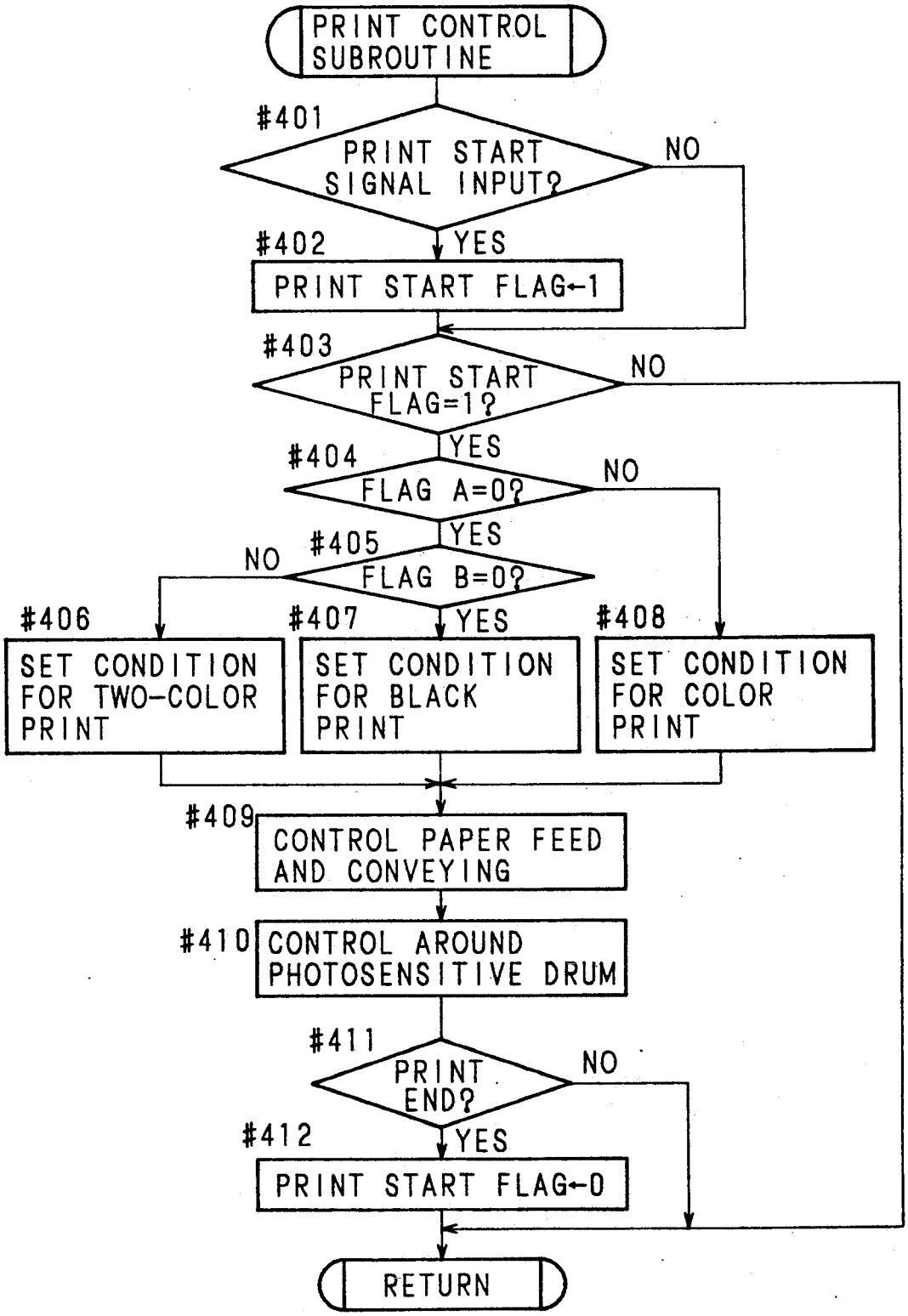
FIG. 18 is a flow chart showing contents of a print control sub-routine.

In the print control subroutine, as FIG. 18 shows, in step #401, decision is made whether or not a print start signal has been inputted. In the case where print start signal has been inputted, a print start flag is set to "1" in step #402. The print start signal is inputted from an input device, such as a computer, to which the printer is connected. By the print start flag being set to "1", condition settings that correspond to the selected print mode are carried out in subsequent steps.

In step #403, it is determined whether or not print start flag has been set to "1". In the case where the setting is "1", subsequent steps from step #404 to step #412 are executed, and in the case where the setting is other than "1", that is, "0", the program will return to the main routine, because no print start signal has been inputted. When print start flag has been set to "1", contents of flags A and B are examined in steps #404 and #405, whereby the selected print mode is determined. In the case where two-color print mode has been selected, developing bias, and charger are set at relevant potential relations respectively in step #406; and similar settings are made in step #407 in the case where black mode has been selected, and in step #408 in the case where color print mode has been selected.

Then, in step #409, the paper feed and conveying system devices are set to printing conditions, and in step #410, devices arranged around the photosensitive drum 1, such as optical system, chargers, developing units, and eraser, are set to print conditions corresponding to the selected mode. Subsequently, in step #411, decision is made as to whether or not printing has ended. In the case where printing is still continued, the program returns to the relevant earlier step # and is kept intact, and when printing ends, print start flag is reset to "0" in step #412, whereupon printing is completed.

Figure 19:
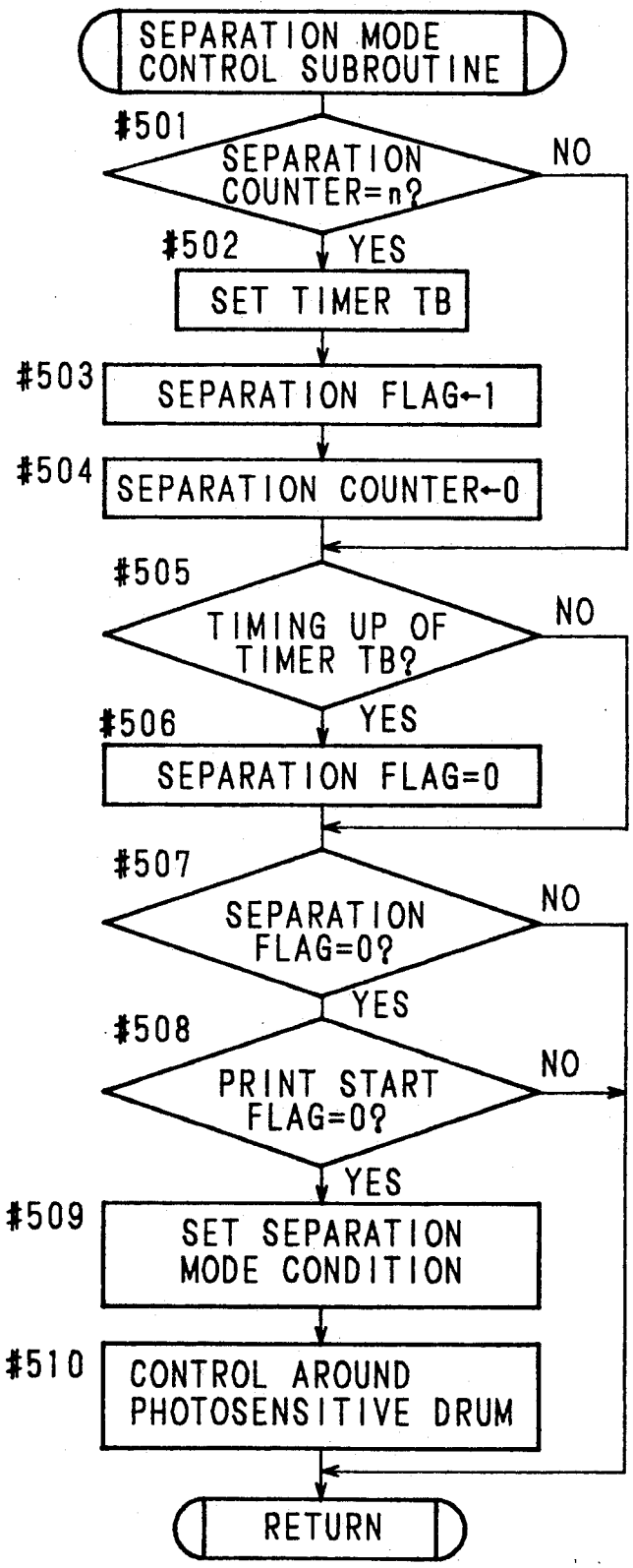
FIG. 19 is a flow chart showing contents of a separation mode control sub-routine.

In the separation mode control subroutine, as FIG. 19 shows, in step #501, it is determined whether the value of the separation counter is n or not. The counter value n serves as a reference for determining whether or not the red toner mixed into the second developing unit 7 is separated. The value has been experimentally determined on the basis of the frequency of red toner supply from the toner hopper 141 to the first developing unit 4 when a large number of two-color image prints were made by driving both the first developing unit 4 and the second developing unit 7, and also of the relationship between the red toner supply frequency and the degree of color mixture on the two-color image. That is, when two-color printing is carried out until the frequency of red toner supply has reached a value n, color mixture can be clearly recognized on the black color image. Therefore, in the case where the decision in step #501 is that the value of the separation counter has reached n, timer TB is set in step #502, and separation flag is changed to "1" in step #503, a separation mode operation being then started. Thereafter, the value of the separation counter is reset to "0" in step #504. It is noted that the timer TB represent the time for separating and collecting the first toner from the second developing unit 7.

Steps #505 and #506 are steps for terminating the separation mode. In step #505, it is determined whether or not the timer TB for execution of the separation mode has been timed up. In the case where the time has been up, separation flag is changed to "0" in step #506, whereupon the separation mode is terminated.

In step #507, decision is made as to whether separation flag is "1" or not. In the case of "1", that is, separation mode is in the course of setting, in step #508, decision is made as to whether print start flag is "0" or not. In the case of "0", that is, no print mode has been set, potentials and other conditions are set to separation mode conditions in step #509. In step #510, devices positioned around the photosensitive drum 1 are set to conditions for separation mode operation and the separation mode is executed accordingly. In the case where print start flag is "1", that is, the print mode is being executed, the execution of the separation mode is prohibited, so that there is no possibility of both print mode and separation mode being concurrently carried out.

Figure 20:
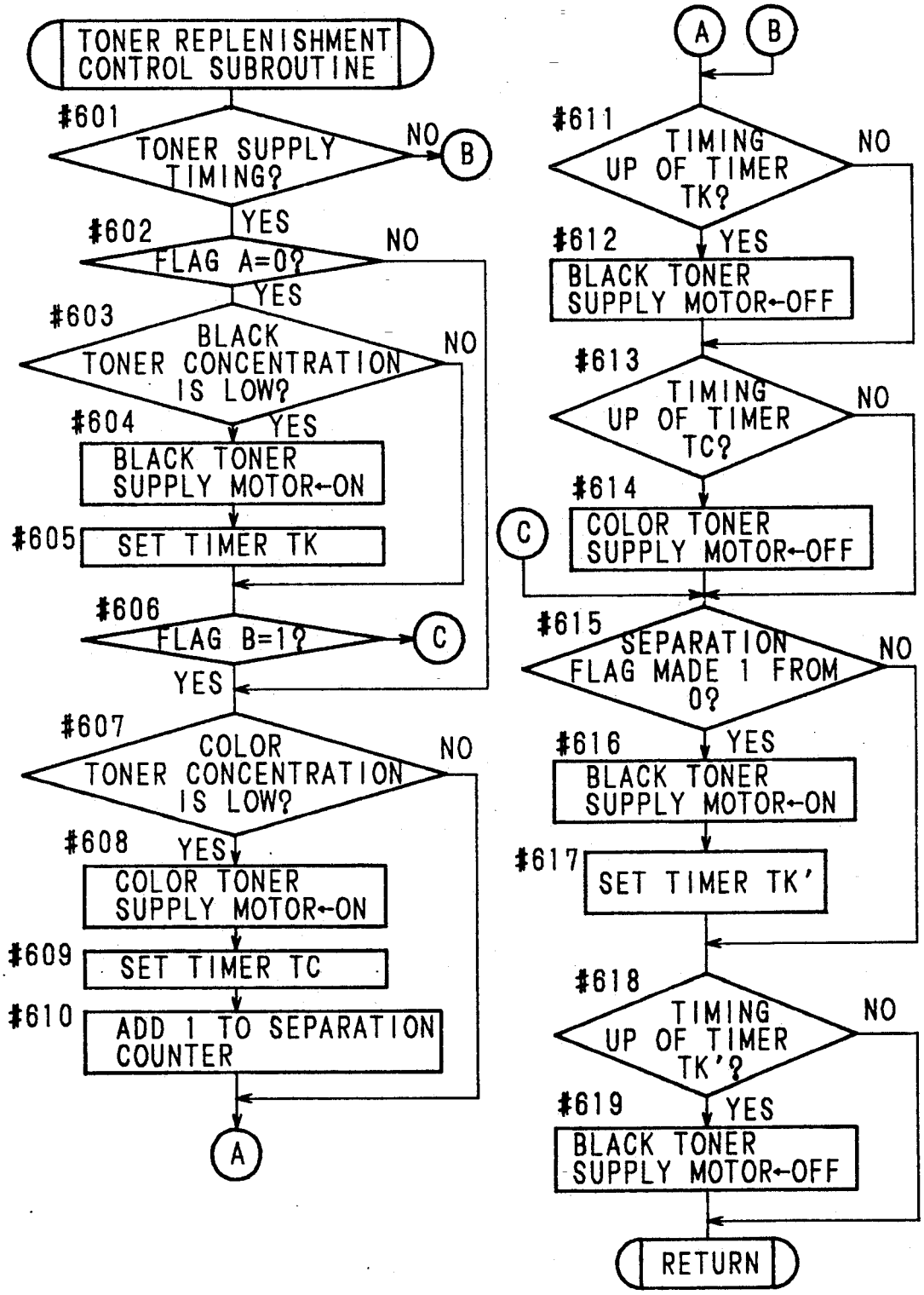
FIG. 20 is a flow chart showing contents of a toner replenishing control sub-routine.

In the toner replenishment control subroutine, as FIG. 20 shows, in step #601 it is determined whether or not toner supply timing is on. In the case where toner supply timing is not on, the program proceeds to step #611, and in the case where toner supply timing is on, the program proceeds to step #602. In step #602, decision is made as to whether flag A is "0" or not. In the case where flag A is "0", that is, black print mode or two-color print mode has been selected, the program advances to step #603, and in the case where flag is "1", that is, color print mode has been selected, the program jumps to step #607. In step #603, decision is made as to whether or not the black toner concentration at the second developing unit 7, or the mix ratio by weight of the black toner to the carrier, is lower than the predetermined reference value. In the case where the black toner concentration is lower than the reference value, the black toner supply motor is driven in step #604 for supplying black toner from the toner hopper to the second developing unit, and a timer TK for controlling supply time therefor is set in step #605, the program then proceeding to step #606. In the case where the black toner concentration is higher than the reference value, the program will advance to step #606 without making black toner supply. In step #606, decision is made as to whether or not flag B is "1". In the case where flag is "1", that is, two-color print mode has been selected, the program will advance to step #607, and in the case where flag B is "0", that is, black print mode has been selected, the program will jump to step #615. In step #607, it is determined whether or not the concentration of the color toner contained in the first developing unit 4 is lower than the reference value. In the case where the decision is that the color toner concentration is lower than the reference value, the color toner supply motor 42 is driven in step #608 for supplying color toner from the toner hopper 141 to the first developing unit 4, and timer TC for controlling the time for color toner supply is set in step #609; then "1" is added to the separation counter in step #610.

In this subroutine, color print mode or two-color print mode is selected as stated above, and when, in that condition, color toner supply has been made to the first developing unit 4, "1" is added to the separation counter. It is noted that the developing units 4, 7 may be equipped respectively with, for example, magnetic sensors to enable measurement of the toner concentration in the developing agent on the basis of the magnetic permeability of the developing agent.

In step #611, decision is made as to whether timer TK has timed up or not. In the case where timer TK has timed up, the black toner supply motor 162 is switched off in step #612 and the program will advance to step #613. In the case where timer TK is in the course of counting, the program will advance to step #613 without executing step #612. In step #613, decision is made as to whether or not timer TC has timed up, and in the case where timer TC has timed up, the color toner supply motor 142 is switched off in step #614 and the program will go to step #615. In the case where timer TC is in the course of counting, the program will go to step #615 without executing step #614. In step #615, it is determined whether or not separation flag has been changed from "0" to "1". It is noted that as already stated, the separation flag is switched over to "1" when the frequency of color toner supply in the two-color print mode has reached the specified value "n".

When it is determined that the separation flag has changed from "0" to "1", the black toner supply motor 162 is switched on in step #616 in order to replenish the supply of black toner consumed in the progress of separation mode operation and in step #617, timer TK' for supply time is set, and the program will advance to step #618. Unless it is determined that separation flag has been changed from "0" to "1", the program will advance to step #618 without executing steps #616 and #617. In step #618, decision is made as to whether timer TK' has timed up or not. When timer TK' has timed up and black toner has been replenished, the black toner supply motor 162 is switched off in step #619, and the program will return to the main routine. In the case where timer TK' has not timed up and is still in the course of counting, the program will return directly to the main routine. The black toner consumed in the separation mode is replenished in this way, and accordingly the supply of toner in the second developing unit 7 can constantly be kept at a reasonable level.

In the foregoing example, as above described, the number of times in which color toner is supplied to the first developing unit 4 when the two-color print mode or color print mode has been selected is counted, and when the value of counting has reached the predetermined value, separation mode processing for separating the color toner which has mixes into the second developing unit 7 is carried out. When the first developing unit 4 is not in operation, there is no possibility of color toner mixed into the second developing unit 7. Therefore, by considering these two modes of operation, it is possible to accurately estimate the amount of color toner mixed into the second developing unit 7.

Figure 21:
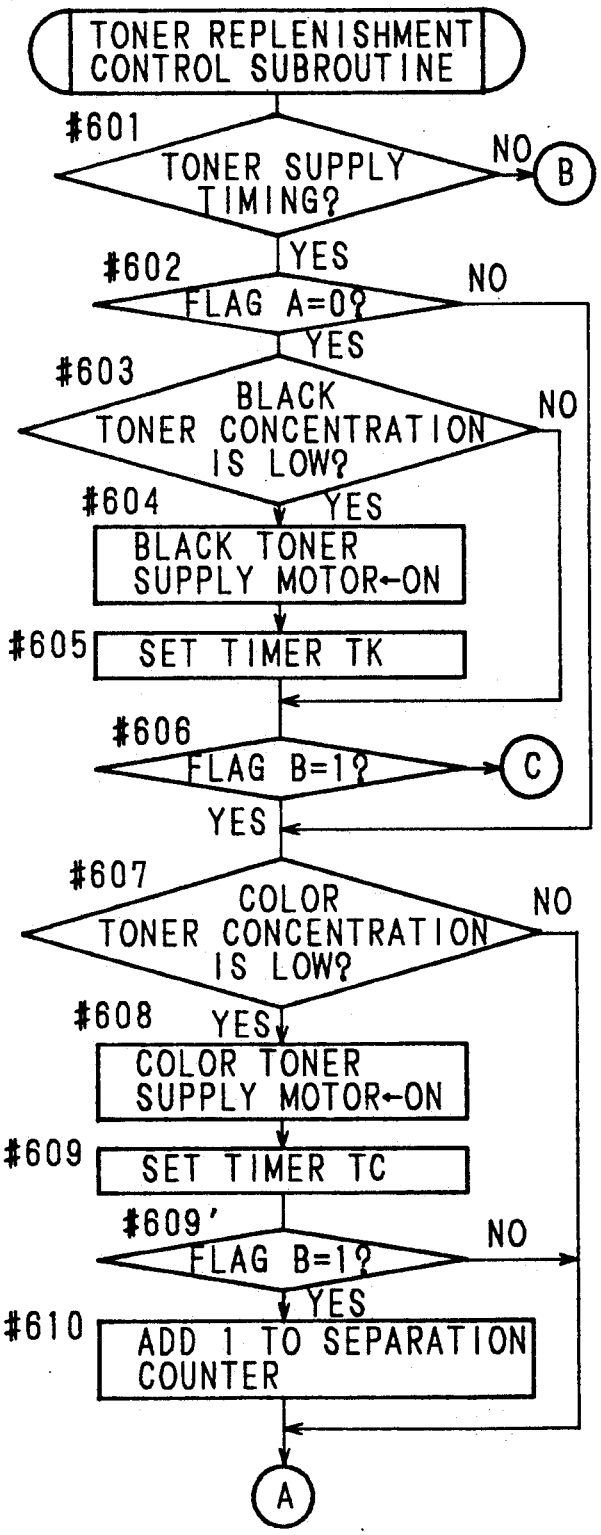
FIG. 21 is a flow chart showing contents of another embodiment of a toner replenishing control sub-routine.

In the foregoing example, in steps #602 and #606 in the toner supply control subroutine, it is determined whether flags A, B are "0" or "1", and in the case where color toner replenishment has been made in a color toner mode operation, that is, in the case of the color print mode or two-color print mode, separation counter is added by "1" each time. Alternatively, however, as FIG. 21 shows, step #609' in which decision is made as to whether flag B is "1" or not, may be added between steps #609 and #610 so that when the two-color print mode has been selected, the separation counter is added by "1" only in the case where color toner replenishment is made. In the case of color print mode, only when the first developing unit 4 is driven, possible color toner mixed into the second developing unit 7 is considerably less than that in the case of two-color print mode. Therefore, by counting the number of times in which color toner replenishment is made in the case of two-color print mode, it is possible to substantially accurately estimate the amount of color toner mixed into the second developing unit 7.

In the above described example, the separation mode is executed automatically when the number of times in which color toner replenishment into the first developing unit 4 is made has reached "n". Alternatively, when the number of times of color toner replenishment has reached "n", the amount mixture of the first toner is measured and, in the case where the amount mixture is more than the predetermined level, the first toner may be separated from the second developing unit 7.

As is clear from the above description, in the second embodiment of the image forming apparatus according to the invention, it is arranged so that the consumption of the first toner is detected and, on the basis of the result of the detection, the first toner is separated and collected from the second developing unit. That is, first toner separation is carried out according to the amount of first toner which has mixed into the second developing unit. This prevents wasteful consumption of second toner and facilitates effective toner utilization.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embarrassed by the claims.

What is claimed is:

1. An image forming apparatus, comprising:

an image holding medium for holding an electrostatic latent image;

image forming means for forming a first electrostatic latent image and a second electrostatic latent image on said image holding medium;

first developing means, containing a first toner of a first color therein, for developing said first electrostatic latent image;

second developing means, containing a second toner of a second color therein, for developing said second electrostatic latent image after said first electrostatic latent image has been developed by said first developing means;

toner separation means for separating said first toner mixed into said second developing means from said second developing means;

first toner consumption detecting means for detecting a value corresponding to consumed amount of said first toner; and control means for controlling said toner separation means to separate said first toner from said second developing means, in response to the value detected by said first toner consumption detecting means.

2. The image forming apparatus as set forth in claim 1, wherein in the case where the value detected by said first toner consumption detecting means is more than a predetermined value, said control means starts the operation of the toner separation means.

3. The image forming apparatus as set forth in claim 1, further comprising second toner consumption detecting means for detecting a value corresponding to consumed amount of said second toner;

wherein said control means controls said toner separation means in response to the values detected respectively by said first toner consumption detecting means and said second toner consumption detecting means.

4. The image forming apparatus as set forth in claim 3, wherein said control means operates said toner separation mean during a first predetermined time in the case where the values detected respectively by said first toner consumption detecting means and said second toner consumption detecting means are within a first predetermined range, and operates said toner separation means during a second predetermined time in the case where said values are within a second predetermined range.

5. The image forming apparatus as set forth in claim 1, wherein said control means operates said toner separation means every time the value detected by said first toner consumption detecting means reaches the value corresponding to a fixed amount of consumption of said first toner.

6. The image forming apparatus as set forth in claim 5, further comprising mixed amount detecting means for detecting the amount of said first toner mixed into said second developing means;

wherein said control means operates said mixed amount detecting means every time the value detected by said first toner consumption detecting means reaches the value corresponding to a fixed consumed amount of said first toner, and operates said toner separation means in the case where the mixed amount detected by said mixed amount detecting means is more than a predetermined amount.

7. An image forming apparatus including a two-color image forming process, which develops a first electrostatic latent image formed on an image holding medium with a first toner contained in a first developing unit, then develops a second electrostatic latent image formed on said image holding medium with a second toner contained in a second developing unit and having a color and physical properties different from said first toner, and transfers the toner images formed respectively by said first and second toners onto a transfer material in a lump, comprising:

first toner consumption detecting means for detecting consumed amount of said first toner;

toner separation means for sticking electrostatically said first toner which has mixed into the second developing unit to an area on a surface of said image holding medium, where said first and second electrostatic latent images are not formed; and control means for controlling said toner separation means in response to the value detected by said first toner consumption detecting means.

8. The image forming apparatus as set forth in claim 7, wherein said first toner is a non-magnetic toner and said second toner is a magnetic toner.

9. An image forming apparatus as set forth in claim 8, wherein in the case where the value detected by said first toner consumption detecting means is more than a predetermined value, said control means operates said toner separation means.

10. The image forming apparatus as set forth in claim 8, further comprising second toner consumption detecting means for detecting consumed amount of said second toner;

wherein said control means controls said toner separation means in response to the values detected respectively by said first toner consumption detecting means and said second toner consumption detecting means.

11. The image forming apparatus as set forth in claim 8, wherein said control means operates said toner separation means every time the value detected by said first toner consumption detecting means reaches the value corresponding to a fixed amount of consumption of said first toner.

12. The image forming apparatus as set forth in claim 11, further comprising a reflection-type optical sensor which is disposed in said second developing unit and detects the amount of said first toner mixed into said second developing unit in response to the amount of reflecting light from a developing agent;

wherein said control means operates said reflection-type optical sensor every time the value detected by said first toner consumption detecting means reaches a value corresponding to the fixed amount of consumption of said first toner, and operates said toner separation means in the case where the mixed amount of said first toner detected by said reflection-type optical sensor is more than a predetermined amount.

13. An image forming apparatus, comprising:

an image holding medium for holding an electrostatic latent image;

plurality of exposing means for forming a first and second electrostatic latent images by respectively exposing different portions on said image holding medium;

a plurality of chargers which charge the surface of said image holding medium uniformly before said first and second electrostatic latent images are formed;

a plurality of developing units including a first developing unit which contains a first toner of a first color and develops said first electrostatic latent image, and a second developing unit which contains a second toner of a second color and develops said second electrostatic latent image;

first toner consumption detecting means for detecting a value corresponding to a consumed amount of said first toner;

mode setting means for selectively setting either an image forming mode under which the image forming operation is executed by using said plurality of exposing means, plurality of charging means and plurality of developing units, or a toner separation mode under which said second developing unit is operated without forming said first and second electrostatic latent images, and said first toner mixed into said second developing unit is stuck electrostatically to the surface of said image holding medium; and mode executing means for allowing said mode selecting means to select said toner separation mode, in the case where the value detected by said first toner consumption detecting means is above the predetermined value.

14. The image forming apparatus as set force in claim 13, further comprising second toner consumption detecting means for detecting a value corresponding to a consumed amount of said second toner;

wherein said mode executing means allows said mode selecting means to select said toner separation mode throughout the time corresponding to the values detected respectively by said first toner consumption detecting means and said second toner consumption detecting means.

15. The image forming apparatus as set forth in claim 14, wherein said mode executing means allows said mode selecting means to select said toner separation mode throughout a first predetermined time in the case where the values detected respectively by said first toner consumption detecting means and said second toner consumption detecting means are within the first predetermined range, and allows said mode selecting means to select said toner separation mode throughout the second predetermined time in the case where said values are within the second predetermined range.

16. The image forming apparatus as set forth in claim 15, wherein said plurality of exposing means respectively include a laser diode and a driver circuit to drive it, and said first and second toner consumption detecting means respectively include counters for counting the light emitting number per fixed time of said laser diode, and detect the values corresponding to consumed amounts of said first and second toner in response to the count values of said counters.

17. The image forming apparatus as set forth in claim 13, wherein said mode executing means allows said mode selecting means to select said toner separation mode, every time the value detected by said first toner consumption detecting means reaches the value corresponding to the fixed amount of consumption of said first toner.

18. The image forming apparatus as set forth in claim 17, further comprising mixed amount detecting means for detecting the amount of said first toner mixed into said second developing unit, every time the value detected by said first toner consumption detecting means reaches the value corresponding to the fixed amount of consumption of said first toner;

wherein said mode executing means allows said mode selecting means to select said toner separation mode in the case where the mixed amount of said first toner detected by said mixed amount detecting means is above the predetermined amount.

19. The image forming apparatus as set forth in claim 18, further comprising:

toner concentration detecting means for detecting the toner concentration in said first developing unit; and toner replenishing means, containing said first toner for replenish, for replenishing a predetermined amount of said first toner to said first developing unit in response to the toner concentration detected by said toner concentration detecting means;

wherein said first toner consumption detecting means detects a value corresponding to consumed amount of said first toner in response to the number of toner replenishings to said first developing unit by said toner replenishing means.

* * * * *